US011578912B2

(12) United States Patent
Chung et al.

(10) Patent No.: US 11,578,912 B2
(45) Date of Patent: Feb. 14, 2023

(54) REFRIGERATOR

(71) Applicant: LG ELECTRONICS INC., Seoul (KR)

(72) Inventors: Myungjin Chung, Seoul (KR); Kyungseok Kim, Seoul (KR); Kyeongyun Kim, Seoul (KR); Giseok Seong, Seoul (KR); Seunguk Ahn, Seoul (KR); Jeongwon Park, Seoul (KR); Yonghun Suh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 16/961,202

(22) PCT Filed: Jan. 10, 2019

(86) PCT No.: PCT/KR2019/000424
§ 371 (c)(1),
(2) Date: Jul. 9, 2020

(87) PCT Pub. No.: WO2019/139389
PCT Pub. Date: Jul. 18, 2019

(65) Prior Publication Data

US 2021/0055042 A1 Feb. 25, 2021

(30) Foreign Application Priority Data

Jan. 10, 2018 (KR) ..... 10-2018-0003516
Jan. 10, 2019 (KR) ..... 10-2019-0003587

(51) Int. Cl.
*F25D 11/02* (2006.01)
*F25D 29/00* (2006.01)
*F25D 31/00* (2006.01)

(52) U.S. Cl.
CPC ..... *F25D 29/00* (2013.01); *F25D 11/02* (2013.01); *F25D 31/005* (2013.01);
(Continued)

(58) Field of Classification Search
CPC ..... F25D 2600/02; F25D 2600/06; F25D 2700/121; F25D 11/02; F25D 17/065; F25D 2317/066; F25D 2317/0682
See application file for complete search history.

(56) References Cited

U.S. PATENT DOCUMENTS 7,076,967 B2 * 7/2006 Lee ..... F25C 1/04 62/353
8,010,484 B2 8/2011 Gernold
(Continued)

FOREIGN PATENT DOCUMENTS

CN 1942725 A 4/2007
CN 1967104 A 5/2007
(Continued)

OTHER PUBLICATIONS

International Search Report from PCT/KR2019/000424, dated May 1, 2019.
(Continued)

*Primary Examiner* — Filip Zec
(74) *Attorney, Agent, or Firm* — Dentons US LLP

(57) ABSTRACT

A refrigerator includes a cabinet in which a storage chamber is formed, a cooler configured to cool the storage chamber, a heater configured to heat the storage chamber, a temperature sensor configured to sense a storage chamber temperature, and a controller configured to control the cooler and the heater, in which the controller selectively performs a plurality of modes, the plurality of modes include a cooling mode in which the cooler is operated or stopped, a heating mode in which the heater is operated or stopped, and a
(Continued)

standby mode in which the cooler and the heater are stopped, and the plurality of modes are performed in the order of the cooling mode, the standby mode, and heating mode, or are performed in the order of the heating mode, the standby mode, and the cooling mode.

20 Claims, 19 Drawing Sheets

(52) U.S. Cl.
CPC .... *F25D 2317/066* (2013.01); *F25D 2400/02* (2013.01); *F25D 2600/02* (2013.01); *F25D 2600/06* (2013.01); *F25D 2700/121* (2013.01)

(56) References Cited

U.S. PATENT DOCUMENTS

| | | | | |
|---|---|---|---|---|
| 8,997,517 | B2 * | 4/2015 | Bertolini | F25D 17/062 62/186 |
| 9,975,462 | B2 | 5/2018 | Doi | |
| 10,712,074 | B2 * | 7/2020 | Scalf | F25D 23/04 |
| 11,084,702 | B2 * | 8/2021 | Chen | B67D 1/0895 |
| 2003/0029178 | A1 | 2/2003 | Zentner et al. | |
| 2003/0097850 | A1 | 5/2003 | Chang et al. | |
| 2005/0236947 | A1 | 10/2005 | LeClear et al. | |
| 2012/0221198 | A1 | 8/2012 | Kohavi et al. | |
| 2014/0208783 | A1 * | 7/2014 | Lee | F25D 17/065 62/89 |
| 2014/0338379 | A1 | 11/2014 | Hatakeyama et al. | |
| 2015/0330678 | A1 * | 11/2015 | Hu | F25C 5/22 62/3.6 |
| 2015/0345860 | A1 * | 12/2015 | Rillo Millán | F25J 1/0276 62/6 |
| 2019/0186803 | A1 | 6/2019 | Seong et al. | |
| 2019/0364915 | A1 * | 12/2019 | Ferrer Blas | A23B 7/148 |
| 2020/0224951 | A1 * | 7/2020 | Seong | F25D 17/065 |

FOREIGN PATENT DOCUMENTS

| | | | |
|---|---|---|---|
| CN | 101048633 | A | 10/2007 |
| CN | 102331135 | A | 1/2012 |
| CN | 103988030 | A | 8/2014 |
| CN | 105051474 | A | 11/2015 |
| CN | 105276905 | A | 1/2016 |
| CN | 105555603 | A | 5/2016 |
| CN | 106104182 | A | 11/2016 |
| CN | 106123454 | A | 11/2016 |
| CN | 109883131 | A | 6/2019 |
| CN | 110732591 | A | 1/2020 |
| DE | 19948119 | A1 | 4/2001 |
| EP | 1221577 | A1 | 7/2002 |
| EP | 1 923 648 | A2 | 5/2008 |
| EP | 3048007 | A1 | 7/2016 |
| JP | 06-011230 | A | 1/1994 |
| JP | 2001-201229 | A | 7/2001 |
| JP | 2001-201230 | A | 7/2001 |
| JP | 2002130908 | A | 5/2002 |
| JP | 2003-083658 | A | 3/2003 |
| JP | 2003-172573 | A | 6/2003 |
| JP | 2014044022 | A | 3/2014 |
| JP | 2017-207264 | A | 11/2017 |
| KR | 1020020057816 | A | 7/2002 |
| KR | 100453236 | B1 | 10/2004 |
| KR | 1020060067605 | A | 6/2006 |
| KR | 10-0725495 | B1 | 6/2007 |
| KR | 10-0889966 | B1 | 3/2009 |
| KR | 1020090075057 | A | 7/2009 |
| KR | 1020090124497 | A | 12/2009 |
| KR | 10-2014-0097863 | A | 8/2014 |
| WO | 2014034380 | A1 | 3/2014 |
| WO | 2014200494 | A1 | 12/2014 |

OTHER PUBLICATIONS

Search Report of European Patent Office in Appl'n. No. 19150921.5-1009, dated May 8, 2019.

Search Report of European Patent Office in Appl'n. No. 19150921.5-1009, dated Feb. 2, 2021.

Office Action of Chinese Patent Office in Appl'n. No. 201910023654.9, dated Jul. 3, 2020.

Office Action of the U.S. Appl. No. 16/238,808, dated Aug. 28, 2020.

* cited by examiner

REFRIGERATOR

This application is a National Stage Application of International Application No. PCT/KR2019/000424, filed on Jan. 10, 2019, which claims priority to Korean Patent Application No. 10-2018-0003516, filed on Jan. 10, 2018 and Korean Patent Application No. 10-2019-0003587, filed on Jan. 10, 2019, all of which are hereby incorporated by reference in their entirety for all purposes as if fully set forth herein.

TECHNICAL FIELD

The present disclosure relates to a refrigerator.

BACKGROUND ART

In general, a refrigerator is a home appliance that allows food to be stored at a low temperature in an internal storage space shielded by a door.

DISCLOSURE

Technical Problem

An object of the present disclosure is to provide a refrigerator that can minimize the deterioration of the quality of the goods stored in the storage chamber.

Another object of the present disclosure is to provide a refrigerator capable of controlling the temperature of the storage chamber to a higher temperature range than a conventional refrigerating chamber, and minimizing the supercooling of the storage chamber or overheating of the storage chamber.

Technical Solution

A refrigerator according to an embodiment of the present disclosure includes a cabinet in which a storage chamber is formed, a cooler configured to cool the storage chamber, a heater configured to heat the storage chamber, a temperature sensor configured to sense a storage chamber temperature, and a controller configured to control the cooler and the heater, in which the controller selectively performs a plurality of modes, the plurality of modes include a cooling mode in which the cooler is operated or stopped, a heating mode in which the heater is operated or stopped, and a standby mode in which the cooler and the heater are stopped, and the plurality of modes are performed in the order of the cooling mode, the standby mode, and heating mode, or are performed in the order of the heating mode, the standby mode, and the cooling mode.

In the cooling mode, the cooler may be operated if the storage chamber temperature sensed by the temperature sensor exceeds a target temperature upper limit value and may be stopped if the storage chamber temperature is lower than a target temperature lower limit value.

In the heating mode, the heater may be stopped if the storage chamber temperature exceeds the target temperature upper limit value and may be stopped if the storage chamber temperature is lower than the target temperature lower limit value.

In the standby mode, the storage chamber temperature may be between the target temperature lower limit value and a lower limit temperature, or between the target temperature upper limit value and an upper limit temperature. The lower limit temperature may be a temperature lower than the target temperature lower limit value. The upper limit temperature may be higher than the target temperature upper limit value.

After the cooling mode is ended, if the time in which the storage chamber temperature is between the target temperature lower limit value and the lower limit temperature is equal to or greater than a first set time, the standby mode may be switched to the heating mode.

After the cooling mode is ended, if the time in which the storage chamber temperature is lower than the lower limit temperature is equal to or greater than a second set time, the standby mode may be switched to the heating mode.

The second set time may be shorter than the first set time.

After the heating mode is ended, if the time in which the storage chamber temperature is between the target temperature upper limit value and the upper limit temperature is equal to or greater than a first set time, the standby mode may be switched to the cooling mode.

After the heating mode is ended, if the time in which the storage chamber temperature exceeds the upper limit temperature is equal to or greater than a second set time, the standby mode may be switched to the cooling mode.

The second set time may be shorter than the first set time.

The refrigerator may further include a timer, and an input unit configured to input the target temperature.

The controller may selectively perform the plurality of modes according to the input unit, the timer, and the temperature sensor.

The refrigerator may further include an airflow forming mechanism configured to flow the air in the storage chamber.

The controller may operate the airflow forming mechanism in the cooling mode.

The controller may stop the airflow forming mechanism in the standby mode.

The controller may operate the airflow forming mechanism in the heating mode.

The cabinet may include an inner case in which the storage chamber is formed. An inner guide configured to partition the storage chamber into a storage space and an air flow path may be disposed inside the inner case. The airflow forming mechanism may include a circulation fan which is disposed in the inner case or the inner guide to circulate air in the storage space.

A partition member which partitions the storage space into a first space and a second space may be disposed in the storage space.

The heater may be provided for each of the first space and the second space.

The inner guide may face a rear body of the inner case. The heater may include a side heating device installed on a side body of the inner case.

The heater may include an inner heating device disposed on the partition member.

Advantageous Effect

According to an embodiment of the present invention, it is possible to store goods with high reliability while minimizing the deterioration of the quality of the goods.

In addition, the temperature of space having a high target temperature can be quickly adjusted to a target temperature range using a cooling means and a heating means, and goods having a high storage temperature can be stored with high reliability.

In addition, in the standby mode, since the storage chamber is not heated or cooled, it is possible to minimize that the storage chamber is rapidly overcooled or rapidly overheated.

In addition, the storage chamber temperature is not maintained for a long time in a low temperature range between the target temperature range and the lower limit temperature, so that the goods can be minimized from being supercooled at a low temperature between the target temperature range and the lower limit temperature.

In addition, if the time in which the storage chamber temperature is lower than the lower limit temperature is equal to or greater than the second set time, the standby mode is switched to the heating mode, so that the user can quickly respond to the user's request even if the user changes and inputs the target temperature.

In addition, the storage chamber temperature is not maintained for a long time in a high temperature range between the target temperature range and the upper limit temperature, so that the quality of the goods can be minimized from being lowered at a lower temperature between the target temperature range and the upper limit temperature.

In addition, if the time in which the storage chamber temperature exceeds the upper limit temperature is equal to or greater than the second set time, the standby mode is switched to the cooling mode, so that the user can quickly respond to the user's request even if the user changes and inputs the target temperature.

In addition, in the standby mode, the airflow forming mechanism is stopped, so that it is possible to minimize the rapid overcooling or rapid overheating of the storage chamber, and the temperature change rate can be slowed down as much as possible.

BEST MODE

Hereinafter, specific embodiments of the present disclosure will be described in detail with reference to the accompanying drawings.

Figure 1:
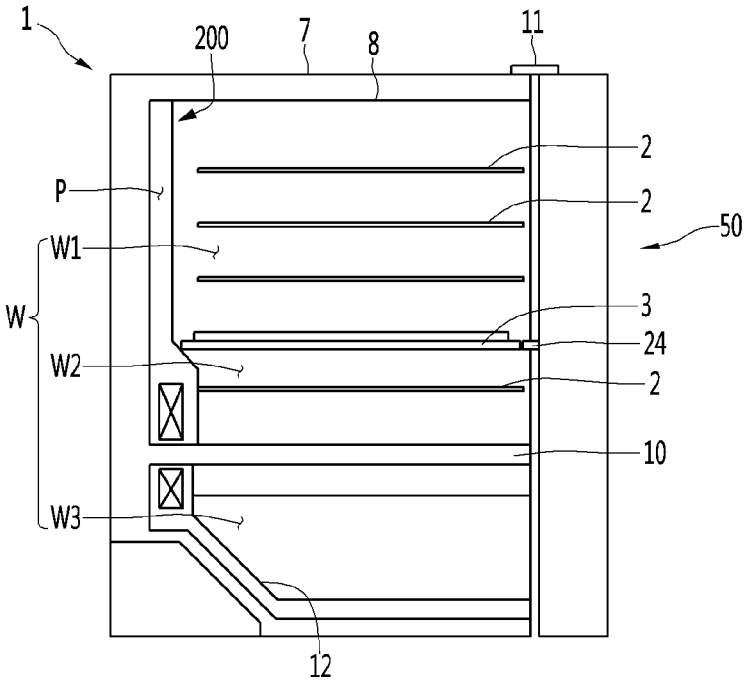
FIG. 1 is a sectional view illustrating an example of a refrigerator according to an embodiment of the present disclosure.

FIG. 1 is a sectional view illustrating an example of a refrigerator according to an embodiment of the present disclosure.

The refrigerator may have a storage chamber W in which goods and the like may be stored. The refrigerator may include a cabinet 1 in which a storage chamber W is formed. The refrigerator may further include a door 50 that opens and closes the storage chamber W. The door 50 may include at least one of a rotatable door 5 and an advancing and retracting type door 6. The cabinet 1 may include an outer case 7 forming an outer appearance and an inner case 8 forming at least one surface for forming the storage chamber W therein.

The storage chamber W may be a storage chamber in which mainly certain kinds of goods which are preferably stored at a specific temperature range are stored. For example, the storage chamber W may be a dedicated storage chamber for storing certain goods that need to be kept warm or cold, for example, alcoholic liquors such as wine and beer, fermented foods, cosmetics, and medical supplies. As one example, the storage chamber for wine can be maintained at a temperature of 3° C. to 20° C., more preferably has a higher temperature than the refrigerating chamber of the normal refrigerator, and is preferable not to exceed 20° C. More preferably the temperature of the storage chamber for red wine can be adjusted to 12° C. to 18° C., the temperature of the storage chamber for white wine can be adjusted to 6° C. to 11° C. Meanwhile, the temperature of the storage chamber for champagne can be adjusted to about 5° C.

The temperature of the storage chamber W can be adjusted such that the storage chamber temperature fluctuates between a target temperature upper limit value and a target temperature lower limit value of the storage chamber W. The quality of the goods stored in the storage chamber W may be reduced by the difference between the target temperature upper limit value and the target temperature lower limit value (hereinafter, referred to as storage chamber temperature difference). The refrigerator may be manufactured with a small storage chamber temperature difference according to the type of the goods and may minimize the reduction of the quality of the goods. The storage chamber W of the refrigerator of the present embodiment may be a storage chamber having a smaller storage chamber temperature difference than that of a general refrigerator. Specifically, the storage chamber temperature difference of the storage chamber W may be less than 3° C., more preferably may be 2° C. as an example. Of course, in a case of considering the goods very sensitive to temperature changes, the storage chamber temperature difference may be less than 1° C.

The refrigerator may include a device capable of adjusting the temperature of the storage chamber W (hereinafter, referred to as a "temperature adjusting device"). The temperature adjusting device may include at least one of cooling means and heating means. The temperature adjusting device may cool or heat the storage chamber W by at least one of conduction, convection, and radiation. For example, a cooling means such as an evaporator 150 or a heat absorbing body of a thermoelectric element may be attached to the inner case 8 to cool the storage chamber W by conduction. By adding an airflow forming mechanism such as a fan, the air heat-exchanged with the cooling means by convection can be supplied to the storage chamber W. Meanwhile, a heating means such as a heater or a heat generating body of the thermoelectric element may be attached to the inner case 8 to heat the storage chamber W by conduction. The addition of an airflow forming mechanism such as a fan can supply heat to the storage chamber W by convection. In the present specification, the cooling means may be defined as a means capable of cooling the storage chamber W, including at least one of the evaporator 150, the heat absorbing body of the thermoelectric element and the fan. In addition, the heating means may be defined as a means capable of heating the storage chamber W, including at least one of a heater, a heat generating body of the thermoelectric element, and a fan.

The refrigerator may further include an inner guide 200. The inner guide 200 may partition an inner portion of the inner case 8 into a space in which goods are stored and a space in which a temperature adjusting device is located (hereinafter referred to as a "temperature adjusting device chamber"). The temperature adjusting device chamber may be a cooling means chamber and a heating means chamber.

For example, the temperature adjusting device chamber can be located between the inner guide 200 and the inner case 8, between the inner guide 200 and the outer case 7, or inside the inner guide 200.

The inner guide 200 may be disposed to partition a cold air flow path P for supplying cold air to the space where goods are stored and the storage chamber W, and at least one of the cooling means may be disposed in the cold air flow path P.

The inner guide 200 may be disposed to partition a space in which goods are stored and a hot air flow path P for supplying heat to the storage chamber W, and at least one of the heating means may be disposed in the hot air flow path P. The inner guide for the cooling means and the inner guide for the heating means can be designed in common and can be manufactured separately.

The inner guide 200 may form a storage space together with the inner case 8. The inner guide 200 may be disposed in front of the rear body of the inner case.

The refrigerator includes both a refrigerator having one space having the same storage chamber temperature range of the storage chamber W and a refrigerator having two or more spaces having different storage temperature ranges from each other.

The refrigerator may further include a partition member 3 disposed vertically or horizontally in order to divide the storage chambers W into two or more spaces (for example, a first space W1 and a second space W2) which have different storage chamber temperatures range from each other.

The refrigerator may further include the partition member 10 disposed vertically or horizontally in order to divide the storage chambers W into two or more spaces (for example, a second space W2, a third space W3) which have different storage chamber temperatures range from each other. The partition member 10 may be separately manufactured and then mounted in the inner case 8. The partition member 10 may be manufactured by foaming together with a heat insulating material disposed between the outer case 7 and the inner cases 8 and 9.

The two or more spaces may be different in size. For example, the first space W1 may be located at the upper side, the second space W2 may be located at the lower side, and the partition member 3 may be disposed so that the size of the first space W1 is larger than the size of the second space W2. The first storage chamber temperature for the first space W may be higher than the second storage chamber temperature for the second space W2.

In the present specification, it can be defined that the meaning that the first storage chamber temperature is higher than the second storage chamber temperature corresponds to at least one case of a case where the maximum value of the first storage chamber temperature is greater than the maximum value of the second storage chamber temperature, a case where the average value of the first storage chamber temperature is greater than the average value of the second storage chamber temperature, and a case where the minimum value of the first storage chamber temperature is greater than the minimum value of the second storage chamber temperature.

The refrigerator may further include a door (hereinafter, a see-through door) through which the user can see the storage chamber through a see-through window without opening the door 50 from the outside of the refrigerator, and the see-through door will be described later.

Meanwhile, the refrigerator may further include a transparent gasket 24 disposed on at least one of the see-through door and the partition members 3 and 10. When the see-through door closes the storage chamber W, the transparent gasket 24 may partition the storage chamber W into two or more spaces having different storage temperature ranges from each other together with the partition members 3 and 10.

The refrigerator may further include door opening modules 11 and 11' for forcibly opening the door 50. The door opening modules 11 and 11' may be a rotatable door opening module 11 which can allow the door 5 to be rotated more than a predetermined angle without the user holding the door 5, or an advancing and retracting type door opening module 11' which can allow the door 6 to be advanced and retracted in a front and rear direction. The door opening modules 11 and 11' will be described later.

The refrigerator may further include a lifting module 13 capable of lifting or lowering the holder 12, and although not illustrated in FIG. 1, the lifting module may be located in at least one of the storage chamber and the door.

The refrigerator may include a plurality of doors for opening and closing two or more spaces having different storage temperature ranges from each other. At least one of the plurality of doors may be a see-through door. At least one of the cabinet 1 or the plurality of doors may include door opening modules 11 and 11'. A lifting module 13 for lifting and lowering the holder located in the storage chamber to open and close may be disposed on at least one of the plurality of doors. For example, the door for the storage chamber located at the top may be a see-through door, and a lifting module 13 for lifting and lowering the holder of the storage chamber located at the lower portion may be disposed.

Figure 2:
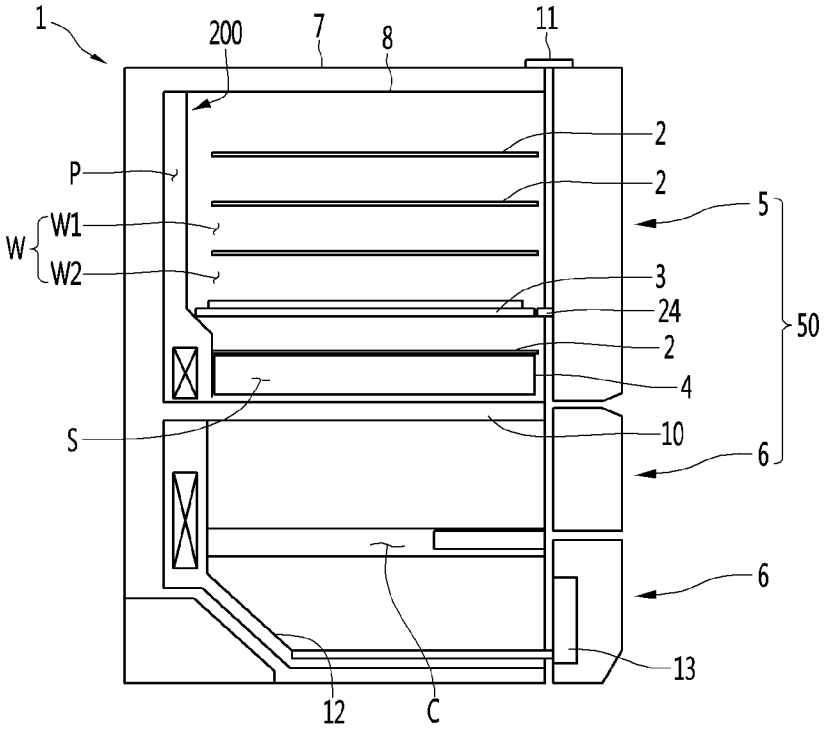
FIG. 2 is a sectional view illustrating another example of a refrigerator according to an embodiment of the present disclosure.

FIG. 2 is a sectional view illustrating another example of a refrigerator according to an embodiment of the present disclosure.

Hereinafter, the storage chamber W illustrated in FIG. 1 will be described as a first storage chamber W.

The refrigerator may further include at least one first storage chamber W and at least one second storage chamber C that may be temperature-controlled independently of the first storage chamber W. Hereinafter, a detailed description of the same configuration and operation as those of the storage chamber W illustrated in FIG. 1 will be omitted for the first storage chamber W, and a different configuration and operation from the storage chamber W illustrated in FIG. 1 will be described.

The second storage chamber C may be a storage chamber having a temperature range lower than the temperature range of the first storage chamber W, and for example, may be a storage chamber having a temperature range of −24° C. to 7° C. and the second storage chamber C may be a storage chamber which is temperature-controlled based on a target temperature, which is a temperature selected by a user in a temperature range of −24° C. to 7° C.

The second storage chamber C may be composed of a switching chamber (or a temperature changing chamber) in which any one of a plurality of temperature ranges may be selected, and may be configured as a non-switching chamber having one temperature range.

The switching chamber is a storage chamber which can be temperature-controlled to a selected temperature range among a plurality of temperature ranges, and the plurality of temperature ranges may include a first temperature range above zero, a second temperature range below zero, and a third temperature range between the first temperature range and the second temperature range.

For example, the user may input an input unit to select the second storage chamber C as a mode (for example, a refrigerating chamber mode) that is a temperature range above zero, and the temperature range of the second storage chamber C may be selected a temperature range above zero (for example, 1° C. to 7° C.). Meanwhile, the user may input an input unit to further input a desired temperature in the temperature range above zero, and the target temperature of the second storage chamber C may be a specific temperature (for example, 4° C.) entered by a user in the temperature range (for example, 1° C. to 7° C.) above zero.

Meanwhile, the user can input the input unit and thus select as a mode in which the second storage chamber C is in the temperature range below zero (for example, freezing chamber mode) or a special mode (for example, a mode for storing a certain kind of goods or kimchi storage mode).

The first storage chamber W may be a specific goods storage chamber in which a particular kind of goods which is preferably stored at a specific temperature range is stored or mainly a certain kind of goods are stored, and the second storage chamber C may be a non-specific goods storage chamber in which a various kinds of goods may be stored in addition to a specific kind of goods. Examples of specific goods may include alcoholic beverages including wine, fermented foods, cosmetics, and medical supplies. For example, the first storage chamber W may be a storage chamber in which wine is stored or a wine chamber in which wine is mainly stored, and the second storage chamber C may be a non-wine chamber in which goods other than wine are stored or goods other than wine are mainly stored.

A storage chamber having a relatively small storage chamber temperature difference among the first storage chamber W and the second storage chamber C may be defined as a constant temperature chamber, and a storage chamber having a relatively large storage chamber temperature difference among the first storage chamber W and the second storage chamber C may be defined as a non-constant temperature chamber.

Any one of the first storage chamber W and the second storage chamber C may be a priority storage chamber which is controlled in priority, and the other may be a subordinate storage chamber which is controlled in relatively subordinate.

The first goods having a large or expensive quality change according to the temperature change may be stored in the priority storage chamber, and the second goods having a small or low quality change according to the temperature change may be stored in the subordinate storage chamber.

The refrigerator may perform a specific operation for the priority storage chamber and a specific operation for the subordinate storage chamber.

The specific operation includes a general operation and a special operation for the storage chamber. A general operation may be defined as a conventional cooling operation for the storage chamber cooling. The special operation may be defined as a defrost operation for defrosting cooling means, a door load response operation that can be performed when predetermined conditions are satisfied after the door is opened, and an initial power supply operation, which is an operation when the power is first supplied to the refrigerator.

The refrigerator may be controlled such that a specific operation for the priority storage chamber is performed first when two operations collide with each other. Here, the collision of the two operations may be defined, in a case where the start condition of the first operation and the start condition of the second operation are satisfied at the same time, as a case where the start condition of the first operation is satisfied and thus the start condition of the second operation is satisfied while the first operation is in progress, and as a case where the start condition of the second operation is satisfied and thus the start condition of the first operation is satisfied while the second operation is in progress.

For example, in the refrigerator, the priority storage chamber may be cooled or heated prior to the subordinate storage chamber when the temperature of the priority storage chamber is not satisfied and the temperature of the subordinate storage chamber is not satisfied.

While the cooling means for cooling the subordinate storage chamber is defrosted, if the temperature of the priority storage chamber is not satisfied, the priority storage chamber may be cooled or heated while the cooling means of the subordinate storage chamber is defrosted.

If the temperature of the priority storage chamber is not satisfied while the subordinate storage chamber is in progress of the door load response operation, the priority storage chamber may be cooled or heated during the door load response operation of the subordinate storage chamber.

Meanwhile, any one of the first storage chamber W and the second storage chamber C may be a storage chamber in which the temperature is adjusted by the first cooling means and the heating means, the other is a storage chamber in which the temperature is adjusted by the second cooling means.

In the refrigerator, a separate receiving member 4 may be additionally disposed in at least one of the first space W1 and the second space W2. In the receiving member 4, a separate space S (hereinafter, referred to as a receiving space) may be formed separately from the first space W1 and the second space W2 to accommodate goods. The refrigerator may adjust the receiving space S of the receiving member 4 to a temperature range different from that of the first space W1 and the second space W2.

The receiving member 4 may be disposed to be located in the second space W2 located below the first space W1. The receiving space S of the receiving member 4 may be smaller than the second space W2. The storage chamber temperature of the receiving space S may be equal to or less than the storage chamber temperature of the second space W2.

In the refrigerator, in order to dispose as many shelves 2 as possible in the first storage chamber W, the length of the refrigerator itself in the vertical direction may be longer than the width in the horizontal direction, and in this case, the length of the refrigerator in the vertical direction may be more than twice the width in the horizontal direction. Meanwhile, since the refrigerator may be rolled over if the length in the vertical direction is too long relative to the width in the horizontal direction, it is preferable that the length in the vertical direction is less than three times the width in the horizontal direction.

Preferred examples of the length in the vertical direction that can store a plurality of the specific goods may be 2.3 to 3 times the width in a left and right direction, and the most preferred example may be 2.4 to 3 times the width in the left and right direction.

Meanwhile, even if the length of the refrigerator in the vertical direction is longer than the width in the left and right direction, in a case where the length of the storage chamber in which the specific goods are substantially stored, for example, the first storage chamber W, in the vertical direction is short, the number of specific goods may not be high. In the refrigerator, preferably, the length of the first storage chamber W in the vertical direction is longer than the length of the second storage chamber C in the vertical direction so that the specific goods can be stored as much as possible. For example, the length of the first storage chamber W in the vertical direction may be 1.1 times to 1.5 times the length of the second storage chamber C in the vertical direction.

At least one of the first door 5 and the second door 6 may be a see-through door, and the see-through door will be described later.

Meanwhile, the refrigerator may further include door opening modules 11 and 11' for forcibly opening at least one of the first door 5 and the second door 6 to the door opening modules 11 and 11', and the door opening modules 11 and 11' will be described later.

In at least one of the first storage chamber W, the second storage chamber C, and the first door 5, and the second door 6, a lifting module 13 capable of lifting the holder 12 is disposed, and the lifting module 13 will be described later.

Figure 3:
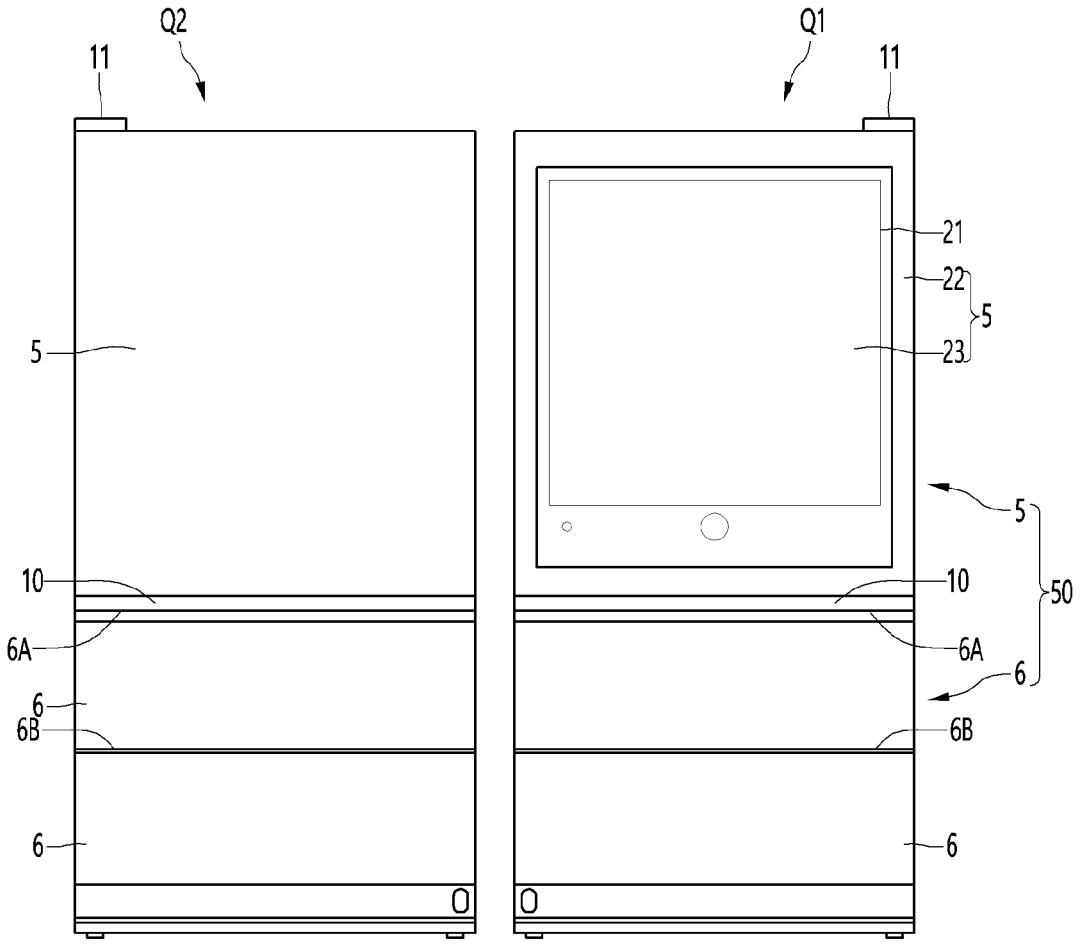
FIG. 3 is a front view when a refrigerator according to an embodiment of the present disclosure is disposed adjacent to another refrigerator.

FIG. 3 is a front view when a refrigerator according to an embodiment of the present disclosure is disposed adjacent to another refrigerator.

The refrigerator of the present embodiment may be disposed adjacent to other refrigerators. A pair of adjacent refrigerators may be disposed in the left and right direction, hereinafter, for convenience of description, the first refrigerator Q1 and the second refrigerator Q2 will be referred for description thereof, and the same configuration of the first refrigerator Q1 and the second refrigerator Q2 as each other will be described using the same reference numerals for convenience of description. Meanwhile, in the refrigerator of the present embodiment, a plurality of storage chambers may be located in the left and right direction and the vertical direction in one outer case, such as a side by side type refrigerator or a French door type refrigerator.

At least one of the first refrigerator Q1 and the second refrigerator Q2 may be a refrigerator to which an embodiment of the present disclosure is applied.

Although the first refrigerator Q1 and the second refrigerator Q2 have some functions different from each other, the lengths of the first and second refrigerators Q1 and Q2 in the vertical direction may have the same or almost similar so that the overall appearance may give the same or similar feeling when disposed adjacent to each other in the left and right direction.

Each of the first refrigerator Q1 and the second refrigerator Q2 may include each of a first storage chamber and a second storage chamber, and the first storage chamber and the second storage chamber may include a partition member 10 partitioning in the vertical direction, respectively, and the partition member 10 of the first refrigerator Q1 and the partition member 10 of the second refrigerator Q2 may overlap in the horizontal direction.

The lower end 6A of the second door 6 opening and closing the second storage chamber of the first refrigerator Q1 and the lower end 6A of the second door 6 opening and closing the second storage chamber of the second refrigerator Q2 can coincide with each other in the horizontal direction.

The lower end 6B of the second door 6 opening and closing the second storage chamber of the first refrigerator Q1 and the lower end 6B of the second door 6 opening and closing the second storage chamber of the second refrigerator Q2 can coincide with each other in the horizontal direction.

Figure 4:
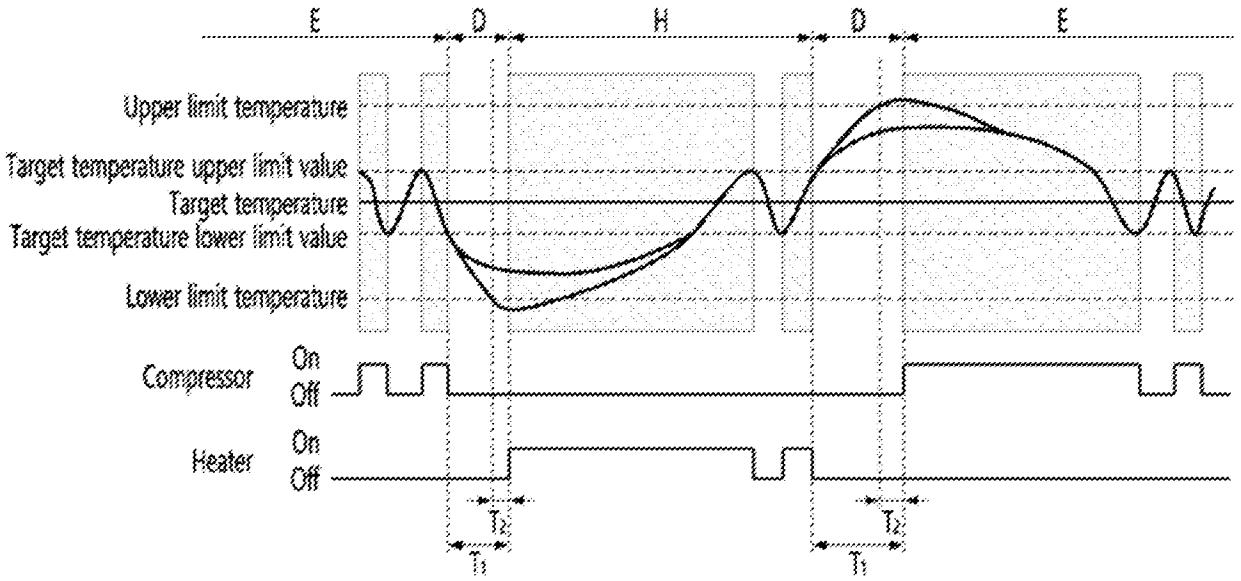
FIG. 4 is a view illustrating on and off of cooling means and on and off of heating means according to the temperature change of the storage chamber according to an embodiment of the present disclosure.

FIG. 4 is a view illustrating on and off of cooling means and on and off of heating means according to the temperature change of the storage chamber according to an embodiment of the present disclosure.

The refrigerator may be provided with cooling means and heating means that can be independently controlled to control the temperature of the storage chamber W.

The refrigerator may include cooling means and heating means for controlling the temperature of at least one storage chamber among a specific goods storage chamber, a constant temperature chamber, and a priority storage chamber.

The refrigerator may be controlled in a plurality of modes for temperature control of the storage chamber W, and the plurality of modes may include a cooling mode E in which the storage chamber W is cooled by the cooling means, a heating mode H in which the storage chamber W is heated by the heating means, and a standby mode (D) which maintains the current state without cooling or heating the storage chamber W.

The refrigerator may include a temperature sensor for sensing a temperature of the storage chamber W and may perform the cooling mode E, the heating mode H, and the standby mode D according to the storage chamber temperature sensed by the temperature sensor.

The cooling mode E is not limited to that the storage chamber W is continuously cooled by the cooling means, and may also include a case where the storage chamber is cooled by the cooling means as a whole, wherein the storage chamber W is temporarily not cooled by the cooling means. The cooling mode E may include a case where the storage chamber W is cooled by the cooling means as a whole, wherein the storage chamber is temporarily heated by the heating means. The cooling mode E may include a case where the time when the storage chamber is cooled by the cooling means is longer than the time when the storage chamber W is not cooled by the cooling means.

The cooling mode E may be a mode in which the cooling means is operated or stopped.

Operation of the cooling means may mean that the cooling means is controlled such that at least a portion of the cooling means is at a temperature lower than the temperature of the storage chamber W. The operation of the cooling means may mean that cool air is supplied to the storage space, may mean to drive a fan for supplying cold air to the storage space, and may mean to open in a case where a damper for controlling air flowing to the storage space is disposed.

For example, when the cooling means is a refrigeration cycle including a compressor, a condenser, an expansion mechanism, and an evaporator, the operation of the cooling means may mean switching the refrigerant valve or driving the compressor to flow the refrigerant to the evaporator. An example of the operation of the cooling means may be to turn on only the fan to use the latent heat remaining in the evaporator while the refrigerant does not flow to the evaporator. The stop of the cooling means may mean that the fan is turned off while the refrigerant valve is switched or the compressor is turned off (that is, the compressor is stopped) so that the refrigerant does not flow to the evaporator.

For example, the cooling mode E may be a mode in which the refrigerant passes through the evaporator, the air in the storage chamber W is cooled by the evaporator, and then flows into the storage chamber W. In the cooling mode E, the compressor may be turned on and off according to the temperature of the storage chamber W. In the cooling mode E, the compressor may be turned on and off such that the storage chamber temperature is maintained between the target temperature lower limit value and the target temperature lower limit value. In detail, the compressor may be turned on when the storage chamber temperature reaches the target upper limit value and may be turned off when the storage chamber temperature reaches the target temperature lower limit value.

As another example, when the cooling means is a heat absorbing body of the thermoelectric element, the operation of the cooling means may mean that current is applied to the thermoelectric element so that the heat of the heat absorbing body of the thermoelectric element is transferred to the heat generating body of the thermoelectric element. An example of the operation of the cooling means may be that only the fan is turned on to use the latent heat remaining in the heat absorbing body of the thermoelectric element while the current is blocked in the thermoelectric element. The stopping of the cooling means may mean that the thermoelectric element and the fan are turned off (that is, blocking the current applied to the thermoelectric element and the fan).

In a case where the refrigerator includes an evaporator for cooling the first space W1, a fan for circulating air to the first space W1 and the evaporator, and a first damper for adjusting air blown into the first space W1, the operation of the cooling means may mean that the compressor and the fan are driven and the first damper is controlled in the open mode. In a case where the refrigerator includes an evaporator for cooling the second space W2, a fan for circulating air to the second space W2 and the evaporator, and a second damper for adjusting the air blown into the second space W2, the operation of the cooling means may mean that the compressor and the fan are driven and the second damper is controlled in the open mode.

When the refrigerator further includes a refrigerant valve for supplying or blocking the refrigerant to the evaporator, the operation of the cooling means may mean to control the refrigerant valve in the evaporator supply mode.

The heating mode H is not limited to the storage chamber W being continuously heated by the heating means, and may also include a case where the storage chamber W is heated by the heating means as a whole, wherein the storage chamber W is temporarily not heated by the heating means, and may also include a case where the storage chamber W is heated by the heating means as a whole, wherein the storage chamber W is temporarily cooled by the cooling means. The heating mode H may include a case where the time for which the storage chamber W is heated by the heating means is longer than the time for which the storage chamber W is not heated by the heating means.

The heating mode H may be a mode in which the heating means is activated or stopped.

Operation of the heating means may mean that the heating means is controlled such that at least a portion of the heating means is at a temperature higher than the temperature of the storage chamber W.

For example, when the heating means is a heater such as a hot wire heater or a planar heater or a heat generating body of the thermoelectric element, the operation of the heating means may mean that the heating means is turned on (current is applied to the heating means). An example of the operation of the heating means may be that only the fan is turned on to use the latent heat remaining in the heating means while the current is blocked in the heating means. The stop of the heating means may mean that the heating means is turned off (blocking current applied to the heating means and the fan). In the heating mode H, the heating means may be turned on and off so that the storage chamber temperature is maintained between the target temperature lower limit value and the target temperature upper limit value. Specifically, the heating means may be turned off when the storage chamber temperature reaches the target temperature upper limit value and may be turned on when the storage chamber temperature reaches the target temperature lower limit value.

When the refrigerator includes a heating device for heating the first space W1 and a fan (or HG fan) for circulating air to the first space W1 and the heating device, operation of the heating means may mean that the heating device is turned on (operated) and the fan (or HG fan) is driven.

When the refrigerator includes an additional heating device for heating the second space W2 and a fan for circulating air to the second space W2 and the additional heating device, operation of the heating means may mean that the additional heating device is turned on (operated) and the fan is driven.

The standby mode D may be a mode in which each of the cooling means and the heating means is stopped.

For example, the standby mode D may be a mode in which the refrigerant does not pass through the evaporator and the heater maintains in an off state. The standby mode D may be a mode in which the heater also maintains the off state while the compressor maintains the off state. The standby mode D may be a mode in which the air in the storage chamber (W) is not forced to flow by the fan.

The plurality of modes may be performed in the order of the cooling mode E, the standby mode D, and the heating mode H over time. The plurality of modes may be performed in the order of the heating mode H, the standby mode D, and the cooling mode E over time. The plurality of modes may be performed in the order of the cooling mode E, the standby mode D, and the cooling mode E over time. The plurality of modes may be performed in the order of the heating mode H, the standby mode D, and the heating mode H over time.

In the plurality of modes, when the cooling mode E and the standby mode D are alternately performed and the starting condition of the heating mode H is reached during the standby mode D, the standby mode D can be ended and the heating mode H can start. In the plurality of modes, when the heating mode H and the standby mode D are alternately performed, and the cooling mode E is started during the standby mode D, the standby mode D can be ended and the cooling mode (E) can start.

The plurality of modes do not immediately switch to the heating mode H without the standby mode D during the cooling mode E and do not immediately switch to the cooling mode E without the standby mode D during the heating mode H.

The refrigerator may include a controller 30 (see FIG. 9) for controlling various electronic devices such as a motor provided in the refrigerator. The controller 30 may control the cooling means and the heating means. The controller 30 can selectively perform a plurality of modes (E) (H) (D).

The cooling mode E may be a mode in which the controller 30 controls the cooling means such that the storage chamber W maintains the target temperature range by the cooling means.

The target temperature range may range from a lower limit value of the target temperature to an upper limit value of the target temperature.

In the cooling mode E, the cooling means may be operated when the temperature of the storage chamber sensed by the temperature sensor (hereinafter, referred to as storage chamber temperature) is higher than the target temperature upper limit value, and may be stopped when the storage chamber temperature is lower than the target temperature lower limit value.

The heating mode H may be a mode in which the controller 30 controls the heating means such that the storage chamber W maintains the target temperature range by the heating means.

In the heating mode H, the heating means may be stopped if the storage chamber temperature is higher than the target temperature upper limit value, and may be operated if the storage chamber temperature is lower than the target temperature lower limit value.

During the operation of the refrigerator, the temperature of the storage chamber W may vary according to the load of the storage chamber W and the ambient temperature of the refrigerator, and the temperature of the storage chamber W may be outside the target temperature range.

An example in which the temperature of the storage chamber W is outside the target temperature range may be a case where the storage chamber temperature is between the target temperature lower limit value and the lower limit temperature.

Another example in which the temperature of the storage chamber W is outside the target temperature range may be a case where the storage chamber temperature is between the target temperature upper limit value and the upper limit temperature.

The lower limit temperature may be lower than the target temperature lower limit value. The lower limit temperature may be a temperature set lower by a set temperature (for example, 2° C.) than the target temperature lower limit value. When the target temperature and the target temperature lower limit value are changed, the lower limit temperature may also be changed according to the changed target temperature and target temperature lower limit value.

The upper limit temperature may be a temperature higher than the target temperature upper limit value. The upper limit temperature may be a temperature set higher by a set temperature (for example, 2° C.) than the target temperature upper limit value. When the target temperature and the target temperature upper limit value are changed, the upper limit temperature may also be changed according to the changed target temperature and target temperature upper limit value.

As described above, when the temperature of the storage chamber may be between the target temperature lower limit value and the lower limit temperature, or between the target u temperature upper limit value and the upper limit temperature, the refrigerator may be in a standby mode, and the controller 30 may stop each of the cooling means and the heating means.

An example of the standby mode D may be a mode in a case where the storage chamber temperature is maintained between the target temperature lower limit value and the lower limit temperature, and the refrigerator does not immediately switch to the heating mode H during the cooling mode E and can be controlled in the order of the cooling mode E, the standby mode D, and the heating mode H. In this case, the refrigerator maintains the standby mode D after the cooling mode E ends, and when the heating mode H starts during the standby mode D, the refrigerator can be switched from the standby mode D to the heating mode H.

After the cooling mode E is ended, if the time in which the storage chamber temperature is between the target temperature lower limit value and the lower limit temperature is equal to or greater than the first set time T1 (for example, 100 minutes), the refrigerator may be switched from the standby mode D to the heating mode H.

After the cooling mode E is ended, the condition that the time in which the storage chamber temperature is between the target temperature lower limit value and the lower limit temperature is equal to or greater than the first set time T1 (for example, 100 minutes) may be a first starting condition of the heating mode H.

The temperature of the storage chamber W, which has been temperature-adjusted in the cooling mode E, may be maintained below the target temperature lower limit value without rising again above the target temperature lower limit value for a long time while being lowered below the target temperature lower limit value. This may be a case where the standby mode D is maintained for a long time after the cooling mode E is ended and the refrigerator cannot be returned to the cooling mode E again.

In a case where the storage chamber W is continued in a state of being lower than the target temperature range for a long time without rising to the target temperature range, deterioration of the quality of the goods stored in the storage chamber W may occur, and, in this case, since the temperature of the storage chamber W cannot rise using the cooling means, the controller 30 may stop the standby mode D and start the heating mode H in order to increase the temperature of the storage chamber W by the heating means.

Meanwhile, after the cooling mode E is finished, if the time when the storage chamber temperature is lower than the lower limit temperature is equal to or greater than the second set time T2 (for example, 5 minutes), the refrigerator can be switched from the standby mode D to the heating mode H. The second set time (for example, 5 minutes) may be shorter than the first set time (for example, 100 minutes).

After the cooling mode E is ended, the condition that the time in which the storage chamber temperature is lower than the lower limit temperature is equal to or greater than the second set time T2 (for example, 5 minutes) may be a second starting condition of the heating mode H.

If the temperature of the storage chamber W, which has been temperature-adjusted in the cooling mode E, reaches a lower limit temperature lower than the target temperature lower limit value, the temperature of the storage chamber W may be excessively lower than the target temperature range. In this case, the controller 30 can stop the standby mode D and start the heating mode H in order to increase the temperature of the storage chamber W by the heating means before the first set time (for example, 100 minutes) is reached.

After the cooling mode E is ended, the controller 30 does not wait for the second set time (for example, 5 minutes) if the storage chamber temperature is lower than the lower limit temperature, and then can immediately switch the standby mode D to the heating mode H. However, the user can input a new target temperature to be lower than before through the input means while the storage chamber temperature is lower than the lower limit temperature, and the refrigerator is already switched to the heating mode (H), so that the user may not respond quickly to a new target temperature input by the user.

As described above, in a case where the time in which the storage chamber temperature is lower than the lower limit temperature is equal to or greater than the second set time (for example, 5 minutes) after the cooling mode is ended, if the controller 30 is switched from the standby mode D to the heating mode H, although the user inputs a new target temperature to be lower than before through the input means, the controller 30 can change the lower limit temperature to be lower than before with reference to the new target temperature before reaching the second set time (for example, 5 minutes), and the controller 30 may determine that the heating mode H is switched based on the newly changed lower limit temperature. In this case, the refrigerator may be switched from the standby mode D to the cooling mode E according to the newly input target temperature, and the unnecessary heating mode H may be minimized. In other words, the refrigerator may respond more quickly to a change in the target temperature of the user.

For convenience of explanation, a case where the target temperature is 16° C., the target temperature lower limit value is 15.5° C., the lower limit temperature is 13.5° C., the target temperature upper limit is 16.5° C., and the upper limit temperature is 18.5° C. will be described as an example.

After the storage chamber temperature is lowered to 15.5° C. or less, the storage chamber temperature is not lowered to 13.5° C. or less and can be maintained for a long time between 15.5° C. and 13.5° C., and the controller 30 can count the time for which the storage chamber temperature is maintained between 15.5° C. and 13.5° C., and if the counted time is equal to or greater than the first set time (for example, 100 minutes), the controller 30 can end the standby mode D and start the heating mode H.

Meanwhile, if the storage chamber temperature is lowered to 15.5° C. or less and then further lowered to 13.5° C. or less, the controller 30 can count the time for which the storage chamber temperature is maintained at 13.5° C. or less, and if the counted time is equal to or greater than the second set time (For example, 5 minutes), the controller 30 can end the standby mode D and start the heating mode H.

In other words, the controller may start the heating mode H when any one of the first starting condition and the second starting condition of the heating mode H is satisfied during the standby mode.

Meanwhile, after the storage chamber temperature is lowered to 13.5° C. or less and before the being reached second set time (for example, 5 minutes), the user can lower the target temperature to 14° C., and when the target temperature is changed, the controller 30 can change the target temperature lower limit value to 13.5° C., change the lower limit temperature to 11.5° C., change the target temperature the upper limit value to 14.5° C., and change the upper limit temperature to 16.5° C.

The controller 30 can compare the storage chamber temperature with the newly changed lower limit temperature of 11.5° C., and when the storage chamber temperature is higher than the newly changed lower limit temperature of 11.5° C., the controller 30 does not switch from the standby mode D to the heating mode H. In this case, the controller 30 may switch from the standby mode D to the cooling mode E when the storage chamber temperature is equal to or higher than the newly changed target upper limit value of 14.5° C. In other words, the refrigerator may quickly respond to a change in the target temperature of the user and minimize the deterioration of the quality of the goods stored in the storage chamber W.

Another example of the standby mode D may be a mode when the storage chamber temperature is maintained between the target temperature upper limit value and the upper limit temperature, the refrigerator does not immediately switch to the cooling mode E during the heating mode H and can be controlled in the order of the heating mode H, the standby mode D, and the cooling mode E. In this case, the refrigerator maintains the standby mode D after the end of the heating mode H, and when the starting condition of the cooling mode E is reached during the standby mode (D), the refrigerator can be switched from the standby mode D to the cooling mode E.

After the heating mode H is ended, if the time for which the storage chamber temperature is between the target temperature upper limit value and the upper limit temperature is equal to or greater than the first set time T1 (for example, 100 minutes), the refrigerator can be switched from the standby mode D to the cooling mode E.

After the heating mode H is ended, the condition that the time for which the storage chamber temperature is between the target temperature upper limit value and the upper limit temperature is equal to or greater than the first set time T1 (for example, 100 minutes) may be the first starting condition of the cooling mode E.

The temperature of the storage chamber W, which has been temperature-adjusted in the heating mode H, may sometimes be maintained above the target temperature upper limit value without lowering back to the target temperature upper limit value or less for a long time in a state where the temperature of the storage chamber W rises above the target temperature upper limit value. The case may be a case where the standby mode D is maintained for a long time after the heating mode H is ended, and the refrigerator cannot be returned to the heating mode H again.

If the storage chamber W is maintained for a long time without being lowered to the target temperature range in a state of being higher than the target temperature range, deterioration of the quality of the goods stored in the storage chamber W may occur, and since the temperature of the storage chamber W cannot be lowered using the heating means, the controller 30 may stop the standby mode D and start the cooling mode E in order to lower the temperature of the storage chamber W by the cooling means.

Meanwhile, after the heating mode H is ended, if the time for which the storage chamber temperature is higher than the upper limit temperature is equal to or greater than the second set time T2 (for example, 5 minutes), the refrigerator can be switched from the standby mode D to the cooling mode E. The second set time (for example, 5 minutes) may be shorter than the first set time (for example, 100 minutes).

After the heating mode H is ended, the condition that the time for which the storage chamber temperature is higher than the upper limit temperature is equal to or greater than the second set time T2 (for example, 5 minutes) may be the second starting condition of the cooling mode E.

When the temperature of the storage chamber W, which has been temperature-adjusted in the heating mode H, reaches the upper limit temperature higher than the target temperature upper limit value, the temperature of the storage chamber W may be excessively higher than the target temperature range. In this case, the controller 30 can stop the standby mode D and start the cooling mode E in order to lower the temperature of the storage chamber W by the cooling means before reaching the first set time (for example, 100 minutes).

After the heating mode H is ended, if the storage chamber temperature is higher than the upper limit temperature, the controller 30 does not wait for the second set time (for example, 5 minutes) and then can immediately switch from the standby mode D to the cooling mode E. However, as described in the switching from the standby mode D to the heating mode H, the user may input a new target temperature, and the refrigerator may not quickly respond to the new target temperature input by the user.

In other words, after the heating mode H is ended, when the storage chamber temperature is higher than the upper limit temperature and the second set time (for example, 5 minutes) elapses, the refrigerator preferably is switched from the standby mode D to the cooling mode E.

For convenience of explanation, a case where the target temperature is 16° C., the target temperature lower limit value is 15.5° C., the lower limit temperature is 13.5° C., the target temperature upper limit value is 16.5° C., and the upper limit temperature is 18.5° C. will be described as an example.

After the storage chamber temperature rises to 16.5° C. or more, the storage chamber temperature can be maintained for a long time between 16.5° C. and 18.5° C. without being lowered to 16.5° C. or less, and the controller 30 can count the time for which the storage chamber temperature is maintained between 16.5° C. and 18.5° C., and if the counted time is equal to or greater than the first set time (for example, 100 minutes), the controller 30 may end the standby mode D and start the cooling mode E.

Meanwhile, after the storage chamber temperature rises to 16.5° C. or more, if the storage chamber temperature is 18.5° C. or more, the controller 30 may count the time for which the storage chamber temperature maintains 18.5° C. or more, and if the counted time is equal to or greater than the second set time (for example, 5 minutes), the controller 30 may end the standby mode D and start the cooling mode E.

In other words, the controller 30 may start the cooling mode E when any one of the first starting condition and the second starting condition of the cooling mode E is satisfied during the standby mode E.

Meanwhile, the plurality of modes may further include a humidification mode for increasing the humidity of the storage chamber.

The humidification mode may be a mode in which at least some of the cooling means are in an off state (for example, the supply of refrigerant to the evaporator is interrupted, the thermoelectric element is off), and in a state where at least some of the heating means are maintained in the off state (for example, the heater is off, the thermoelectric element is off), air in the storage chamber W may flow into the cooling means chamber by a fan to be humidified, and the humidified air may flow into the storage chamber W to humidify the storage chamber.

For example, the humidification mode may be a mode in which in a state where the refrigerant does not pass through the evaporator and the heater maintains a state of turning off, the air in the storage chamber flows to the evaporator by a fan to be humidified, and the humidified air flows into the storage chamber to humidify the storage chamber. In the humidification mode, a fan that circulates air in the storage chamber to the evaporator and the storage chamber may be driven.

Figure 5:
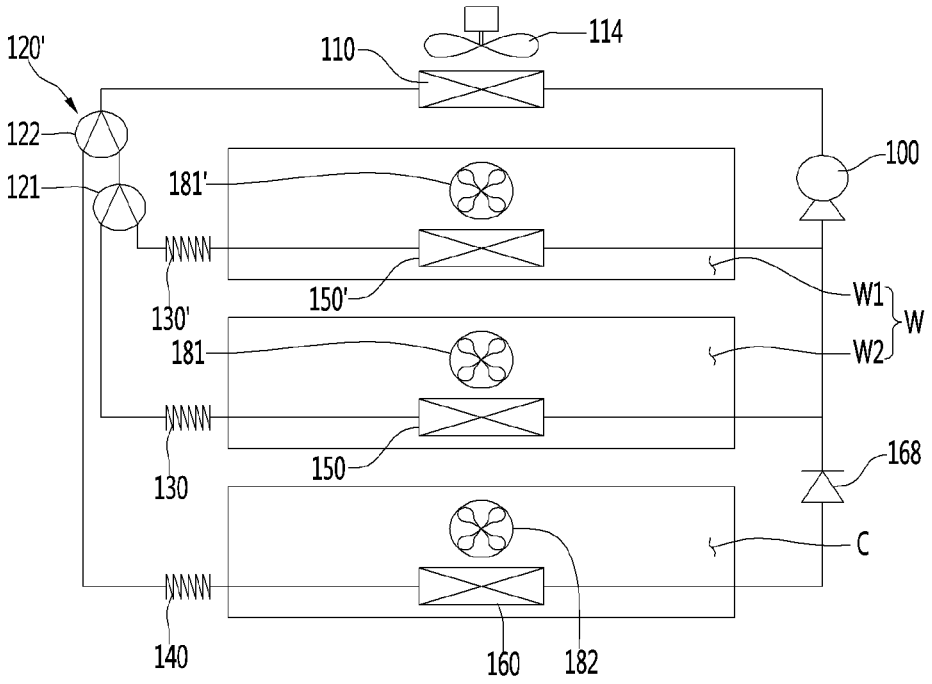
FIGS. 5 to 8 are views illustrating examples of a refrigeration cycle of a refrigerator according to an embodiment of the present disclosure.
Figure 6:
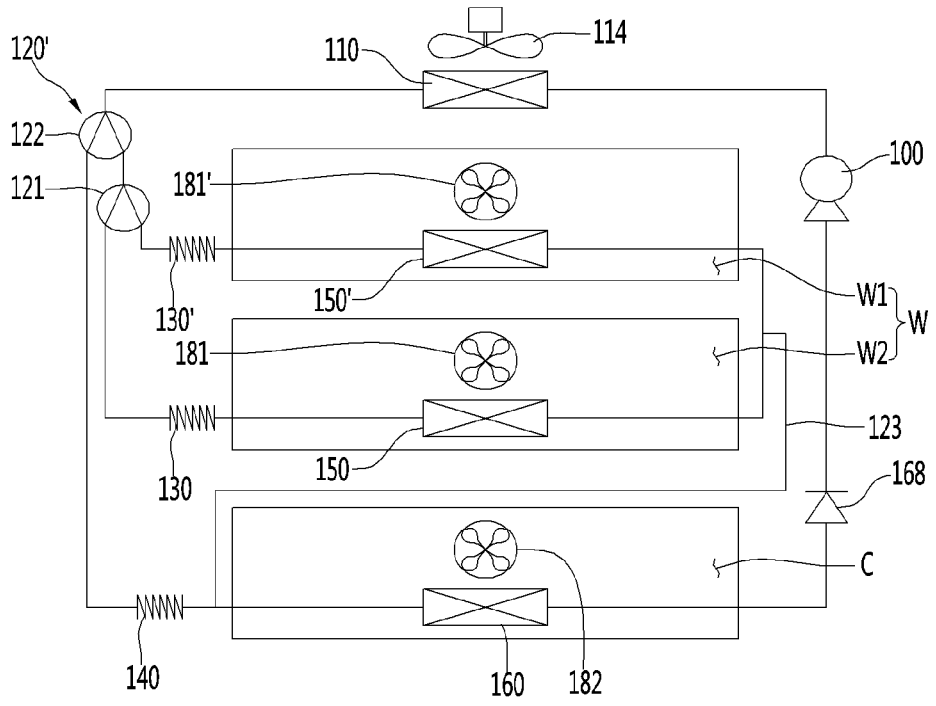
Figure 7:
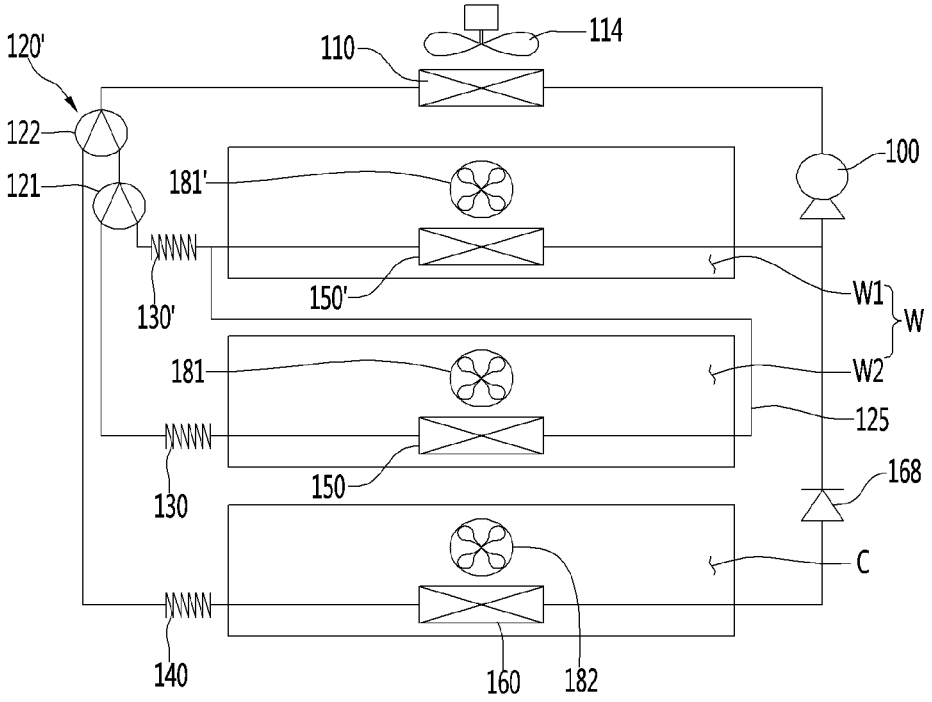
Figure 8:
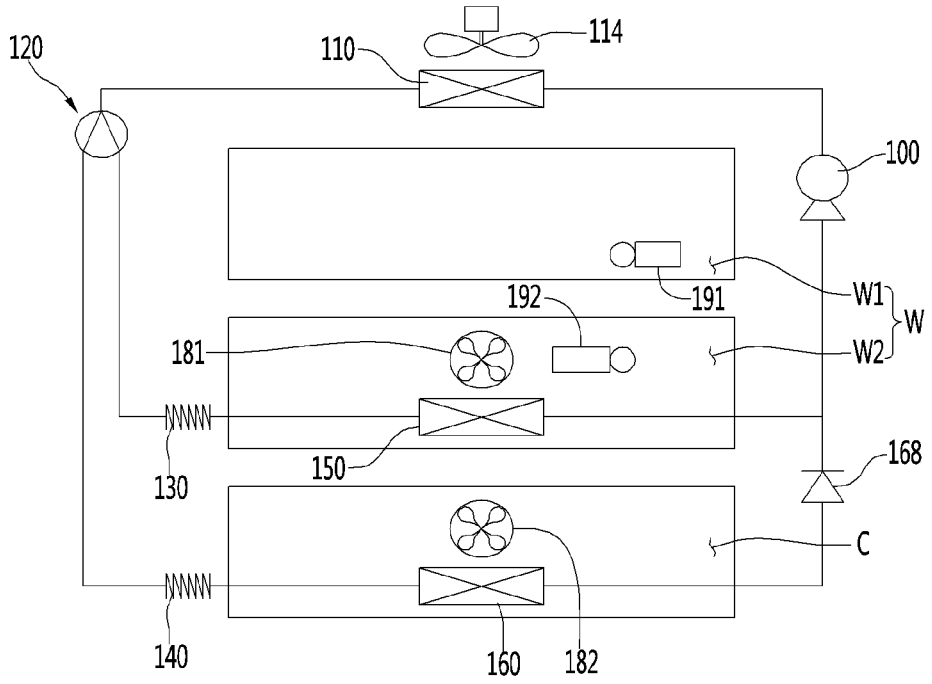

FIG. 5 is a view illustrating a first example of a refrigeration cycle of a refrigerator according to an embodiment of the present disclosure, FIG. 6 is a view illustrating a second example of a refrigeration cycle of a refrigerator according to an embodiment of the present disclosure, FIG. 7 is a view illustrating a third example of a refrigeration cycle of a refrigerator according to an embodiment of the present disclosure, and FIG. 8 is a diagram illustrating a fourth example of a refrigeration cycle of a refrigerator according to an embodiment of the present disclosure.

The refrigeration cycles illustrated in FIGS. 5 to 8 may be applied to a refrigerator having three spaces (hereinafter, referred to as 1, 2, and 3 spaces) having different storage temperature ranges from each other. For example, The refrigeration cycles may be applied to at least one of i) a refrigerator having a first space W1, a second space W2, and a third space W3, ii) a refrigerator having a first storage chamber W having the first space W1 and the second space W2, and a second storage chamber C partitioned from the first storage chamber W, and iii) a refrigerator having a first storage chamber W and two second and third storage chambers partitioned from the first storage chamber W.

The refrigeration cycle illustrated in FIGS. 5 to 7 may include a compressor 100, a condenser 110, a plurality of expansion mechanisms 130', 130, 140, and a plurality of evaporators 150', 150, 160 and may further include a flow path switching mechanism 120'.

A case where the first region is the first space W1, the second region is the second space W2, and the third region is the second storage chamber C will be described below. The first, second, and third regions are also applicable to cases ii) and iii) described above.

The plurality of evaporators 150', 150, 160 may include a pair of first evaporators 150', 150 capable of independently cooling the first space W1 and the second space W2, respectively, and a second evaporator 160 that can cool a second storage chamber C.

One of the pair of first evaporators 150' and 150 may be an evaporator 150' cooling the first space W1, and the other of the pair of first evaporators 150' and 150 may be an evaporator 150 cooling the second space W2.

The plurality of expansion mechanisms 130', 130, and 140 may include a pair of first expansion mechanisms 130' and 130 connected to a pair of first evaporators 150' and 150, and a second expansion mechanism 140 connected to a second evaporator 160. Any one of the pair of first expansion mechanisms 130' and 130 may be an expansion mechanism 130' connected to any one 150' of the pair of first evaporators 150' and 150, and the other of the pair of first expansion mechanisms 130' and 130 may be an expansion mechanism 130 connected to the other one 150 of the pair of first evaporators 150' and 150.

The flow path switching mechanism 120' may include a first valve 121 capable of controlling a refrigerant flowing into the pair of first expansion mechanisms 130' and 130, and a second valve 122 capable of controlling a refrigerant flowing into the first valve 121 and the second expansion mechanism 140.

The refrigerator having the refrigeration cycle illustrated in FIGS. 5 to 7 may include a pair of first fans 181' and 181, and a second fan 182 for circulating cold air in the space of the second storage chamber C to the space of the second evaporator 160 and the second storage chamber C and may further include a condensation fan 114 for blowing outside air to the condenser 110.

Any one 181' of the pair of first fans 181' and 181 may be a fan for the first space in which cold air in the first space W1 can be circulated into any one 150' of the pair of first evaporators 150' and 150 and the first space W1. In addition, the other one 181 of the pair of fans 181' and 181 may be a fan the second space in which cold air in the second space W2 can be circulated into any one 150 of the pair of first evaporators 150' and 150 and the second space W2.

The refrigeration cycle illustrated in FIG. 5 may include a first parallel flow path in which a pair of first evaporators 150' and 150 are connected in parallel and a second parallel flow path in which a pair of first evaporators 150' and 150 are connected to the second evaporator 160 in parallel. In this case, a one-way valve 168 may be installed at an outlet side of the second evaporator 160 to prevent the refrigerant at the outlet side of the second evaporator 160 from flowing back to the second evaporator 160.

The refrigeration cycle illustrated in FIG. 6 may include a parallel flow path in which a pair of first evaporators 150' and 150 are connected in parallel and a serial flow path 123 in which the pair of first evaporators 150' and 150 are connected to a second evaporator 160 in series. One end of the serial flow path 123 may be connected to a parallel flow path in which a pair of first evaporators 150' and 150 are connected in parallel. The other end of the serial flow path 123 may be connected between the second expansion mechanism 140 and the inlet of the second evaporator 160. In this case, a one-way valve 168 may be installed at the outlet side of the second evaporator 150 to prevent the refrigerant at the outlet side of the second evaporator 150 from flowing back to the second evaporator 150.

The refrigeration cycle illustrated in FIG. 7 may include a serial flow path 125 in which a pair of first evaporators 150' and 150 are connected in series, and, a parallel flow path in which the pair of first evaporators 150' and 150 are connected to the second evaporator 160 in parallel. One end of the serial flow path 125 may be connected to the outlet side of any one 150 of the pair of first evaporators 150' and 150. The other end of the serial flow path 125 may be connected to an inlet side of the other 150' of the pair of first evaporators 150' and 150'. In this case, a one-way valve 168 may be installed at the outlet side of the second evaporator 160 to prevent the refrigerant at the outlet side of the second evaporator 160 from flowing back to the second evaporator 160.

The refrigeration cycle illustrated in FIG. 8 may include one first evaporator 150 instead of the pair of first evaporators 150' and 150 illustrated in FIGS. 5 to 7, and one first expansion mechanism 130 instead of the pair of expansion mechanism 130' and 130. In addition, the refrigeration cycle illustrated in FIG. 8 may include a flow path switching mechanism 120 for controlling the refrigerant flowing into the first expansion mechanism 130 and the second expansion mechanism 140, and the flow path switching mechanism 120 may include a refrigerant valve that can be switched so that the refrigerant flowing from the condenser 110 flows to the first expansion mechanism 130 or the second expansion mechanism 140. In addition, a one-way valve 168 may be installed at the outlet side of the second evaporator 160 to prevent the refrigerant at the outlet side of the second evaporator 160 from flowing back to the second evaporator 160.

Since other configurations and actions other than one first evaporator 150, one first expansion mechanism 130, a flow path switching mechanism 120, and a one-way valve 168 of the refrigeration cycle illustrated in FIG. 8 are the same as or similar to those of the refrigeration cycle illustrated in FIGS. 5 to 7, a detailed description with respect to those will be omitted.

Meanwhile, the refrigerator having a refrigeration cycle illustrated in FIG. 8 may include a first fan 181 circulating cold air of the first storage chamber W into the first evaporator 150 and the first storage chamber W instead of the pair of first fans 181' and 181 illustrated in FIGS. 5 to 7. In addition, the refrigerator having the refrigeration cycle illustrated in FIG. 8 may include a first damper 191 for controlling cold air flowing into the first space W1 after being cooled by the first evaporator 150 and a second damper 192 for controlling the cold air flowing into the second space W2 after being cooled by the first evaporator 150. Only one of the first damper 191 and the second damper 192 may be provided. Meanwhile, in the refrigerator, one damper may selectively supply air cooled by the evaporator 150 to at least one of the first space W1 and the second space W2.

Modification examples of the refrigeration cycle illustrated in FIGS. 5 to 8 may be applied to a refrigerator having two spaces having different storage temperature ranges from each other. In other words, the modification examples of the refrigeration cycle may be applied to a refrigerator having a first space W1 and a second space W2 or a refrigerator having a first storage chamber W and a second storage chamber C. Meanwhile, the refrigeration cycle can be configured with a cycle which does not include the flow path switching mechanisms 120 and 122, the second expansion mechanism 140, the second evaporator 160, the second fan 182, and the one-way valve 168.

The refrigeration cycle illustrated in FIGS. 5 to 8 may constitute a cooling means capable of cooling the storage chamber.

Figure 9:
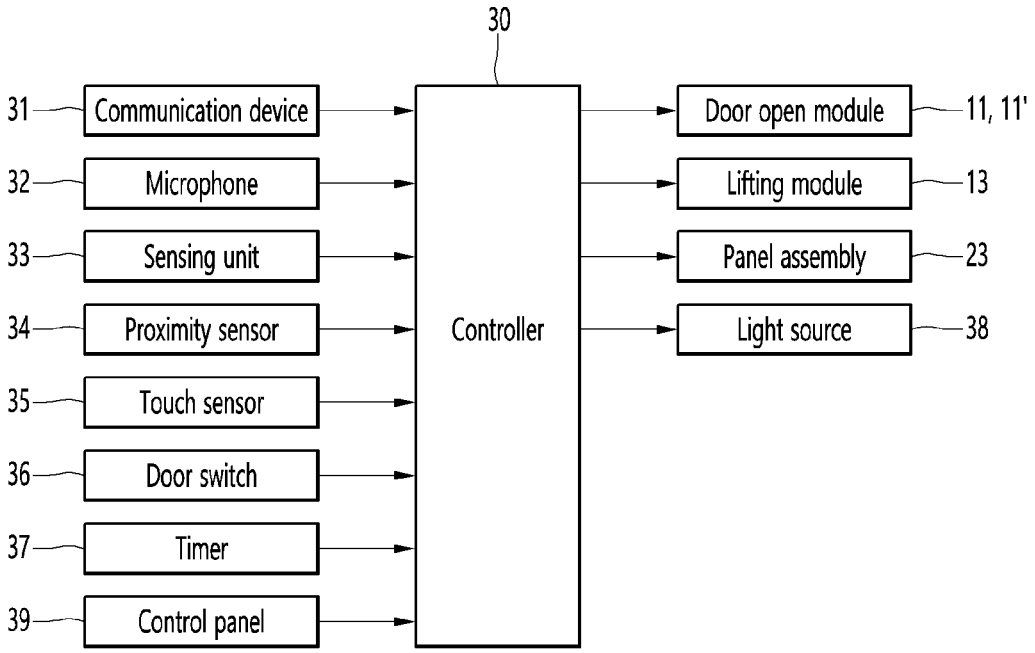
FIG. 9 is a control block diagram of a refrigerator according to an embodiment of the present disclosure.

FIG. 9 is a control block diagram illustrating a refrigerator according to an embodiment of the present disclosure.

The refrigerator may include a controller 30 that controls various electronic devices such as a motor provided in the refrigerator.

The controller 30 may control the refrigerator according to the input value of the input means.

The input means may include at least one of a communication device 31 which receives a signal from an external device such as a remote controller such as a remote controller or a mobile terminal such as a mobile phone, a microphone 32 that changes a user's voice to a sound signal, a sensing unit 33 which can sense a user's motion, a proximity sensor 34 (or a distance sensor) which can sense the user's proximity, a touch sensor 35 which can sense the user's touch, a door switch 36 which can detect the opening and closing of the door, a timer 37 which can measure the lapse of time, and a control panel 39 which can input various input values such as the target temperature by the user.

The see-through door may be a door in which a state which can see through (see-through activation state) and a state which cannot see through (see-through deactivation state) can be selected. The see-through door may be a door that is changed from a see-through deactivation state to a see-through activation state according to an input value provided to the controller 30 through the input means. The see-through door may be a door that is changed from a see-through activation state to a see-through deactivation state according to an input value provided to the controller 30 through the input means.

The sensing unit 33 may be a vibration sensor disposed on the rear surface of the front panel, the vibration sensor may be formed in black, and the visible exposure may be minimized. The sensing unit 33 may be a microphone disposed on the rear surface of the front panel, and the microphone may sense sound waves of vibration applied to the front panel. When a user taps the panel assembly 23 a plurality of times at a predetermined time interval is detected through the sensing unit 33, the user may change the see-through door to be activated or deactivated. The sensing unit 33 may be a means for imaging a user's motion. It may be determined whether the image photographed by the sensing unit 33 is similar or identical to a specific motion input in advance, and may be changed to activate or deactivate the see-through door according to the determination result.

If it is determined that the user is close to the predetermined distance or more according to the value detected by the proximity sensor 34, the see-through door may be changed to be activated or deactivated.

When it is determined that the door is closed according to the value detected by the door switch 36, the see-through door may be activated, and when it is determined that the door is open, the see-through door may be changed to be inactivated.

The see-through door may be controlled to be deactivated after a certain time elapses after being activated according to the value input through the timer 37. According to the value input through the timer 37, the see-through door may be controlled to be activated when a predetermined time elapses after being deactivated.

As an example in which the see-through door is activated or deactivated, there may be a case where the transparency of the see-through door itself may vary. For example, the see-through door may remain opaque when no current is applied to the panel assembly 23 and may be changed to be transparent when current is applied to the panel assembly 23. In another example, when the light source 38 installed inside the see-through door is turned on, the user may see the storage chamber through the see-through door by the light emitted from the light source 38.

The light source 38 may make the panel assembly 23 appear transparent or translucent so that an inside of the refrigerator (a side of the storage chamber relative to the panel assembly) looks brighter than outside of the refrigerator (outside relative to the panel assembly).

The light source 38 may be mounted on the light source mounting portion formed on the cabinet 1 or the light source mounting portion formed on the door and may be disposed to emit light toward the panel assembly 23.

The controller 30 may control the door opening module 11 according to the input value of the input means. The controller 30 may control the lifting module 13 according to the input value of the input means.

Figure 10:
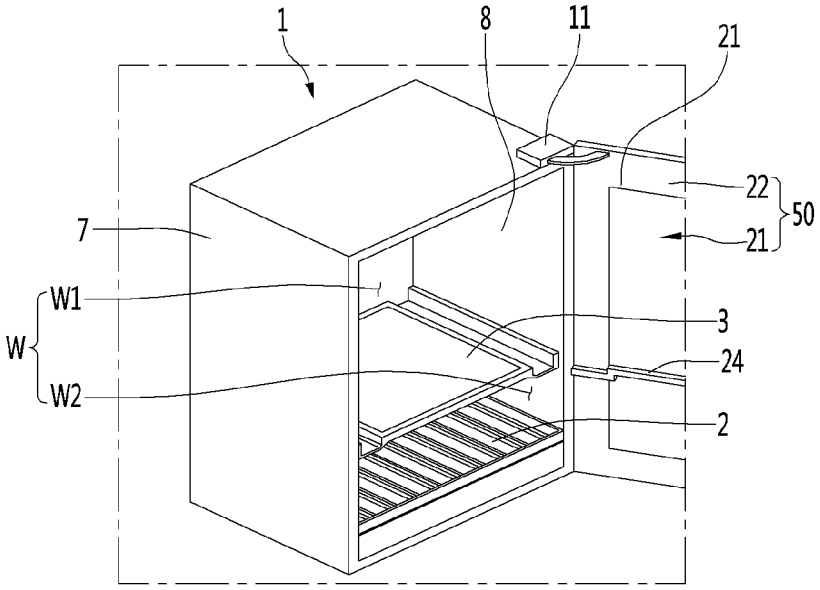
FIG. 10 is a perspective view illustrating a see-through door of a refrigerator according to an embodiment of the present disclosure.

FIG. 10 is a perspective view illustrating a see-through door of a refrigerator according to an embodiment of the present disclosure.

The refrigerator may include a door (hereinafter, a see-through door) through which a user may view the storage chamber through a see-through window without opening the door 50 from the outside of the refrigerator.

The see-through door may include an outer door 22 and a panel assembly 23.

The outer door 22 may be opaque and an opening portion 21 may be formed. The outer door 22 may form an outer appearance of the see-through door. The outer door 22 may be rotatably connected to or connected to the cabinet 1 to be capable of being advanced and retracted.

The panel assembly 23 may be disposed in the opening portion 21. The panel assembly 23 may be disposed to shield the opening portion 21. The panel assembly 23 can form the same outer appearance as the front surface of the outer door 22.

The see-through door is preferably provided to open and close the storage chamber which mainly stores goods (for example, wine) having a large quality change according to the temperature change.

In a case where goods having a large quality change due to temperature change are mainly stored in the storage chamber W, the storage chamber W is preferably opened and closed as short as possible, the number of opening and closing is preferably minimized, and the see-through door is preferably installed to open and close the storage chamber W.

For example, the see-through door is preferably provided in the door for opening and closing at least one of the specific goods storage chamber, the constant temperature chamber, and the priority storage chamber.

Figure 11:
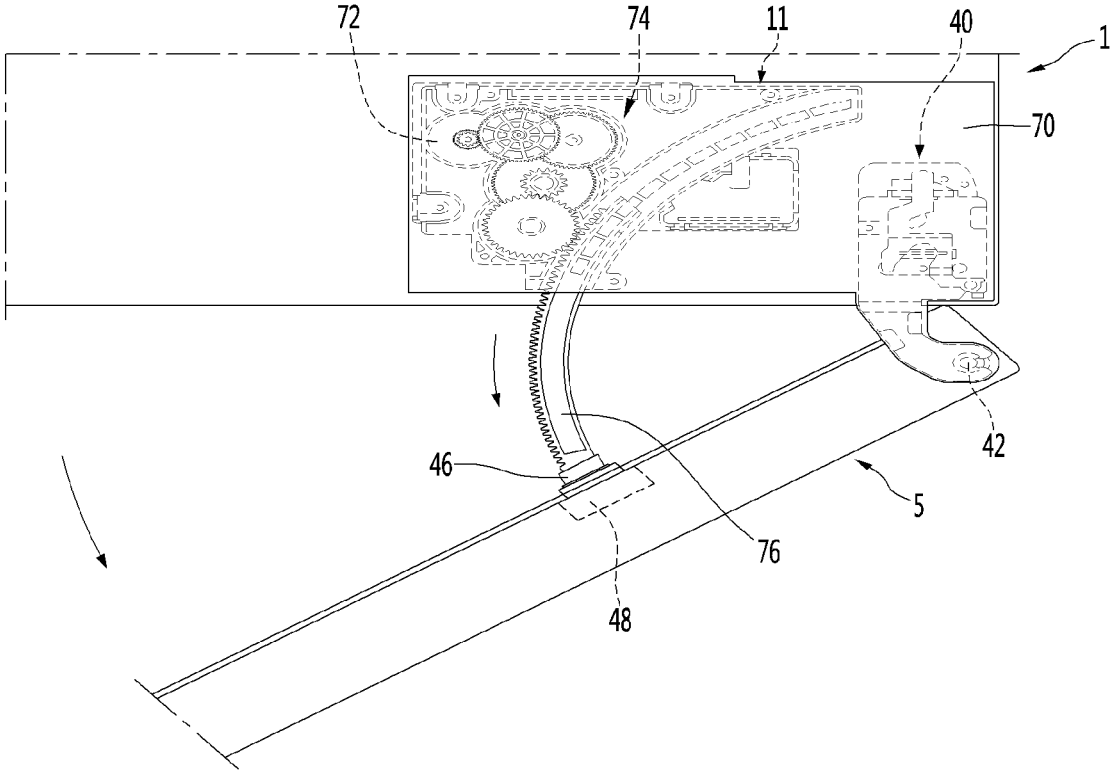
FIG. 11 is a plan view when an example of a door according to an embodiment of the present disclosure is opened in a door opening module.

FIG. 11 is a plan view when an example of a door according to an embodiment of the present disclosure is opened in a door opening module.

In the refrigerator, a door opening and closing the storage chamber may be an automatic door, and the door for opening and closing the specific goods storage chamber, the constant temperature chamber, and a priority storage chamber may be an automatic door.

The refrigerator may include a door opening module 11 for forcibly opening the door 5.

The automatic door may be controlled to be opened or closed according to an input value provided to the controller 30 through the input means. For this purpose, the controller 30 may control the door opening module 11.

The door opening module 11 may automatically open the door 5 rotatably connected to the cabinet 1. The door 5 may be a rotary automatic door that is automatically opened by the door opening module 11. The cabinet 1 may be provided with a hinge mechanism 40 in which the hinge shaft 42 is connected to the door 5. The refrigerator may further include a module cover 70 that may cover the hinge mechanism 40 and the door open module 11 together. In addition, the door opening module 11 may include a drive motor 72, a power transmission unit 74, and a push member 76.

When the power of the refrigerator is turned on, the controller 30 may wait to receive an open command of the door 5. When the door opening command is input through the input means, the controller 30 may transmit an opening signal to the drive motor 72 included in the door opening module 11.

When the controller 30 transmits an opening signal to the drive motor 72, the drive motor 72 may be rotated in a first direction to move the push member 76 from the initial position to the door opening position.

When the drive motor 72 rotates in the first direction, the power transmission unit 74 may transmit a first direction rotational force of the drive motor 72 to the push member 76, and the push member 76 may push the door while protruding forward, and the door 5 may be rotated in the forward direction with respect to the cabinet 1.

The controller 30 may determine whether the push member 76 has reached the door opening position in a process of rotating in the first direction of the drive motor 72. For example, the controller may determine that the push member 76 has reached the door opening position when the cumulative rotational speed of the drive motor 72 reaches the reference rotational speed. The controller 30 may stop the rotation of the drive motor 72 when it is determined that the push member 76 has moved to the door opening position.

In a state where the door 5 is rotated by a predetermined angle, the user can manually increase the opening angle of the door 5.

When the user increases the opening angle of the door in a state where the push member 76 moves the door 5 to the door opening position, the door sensor including a magnet 46 and a reed switch 48 can sense the manual opening of the door 5, and if the manual opening of the door 5 is sensed by the door sensor, the controller 300 can output a return signal to the drive motor 72.

The controller 30 may transmit the return signal to the drive motor 72 so that the push member 76 returns to the initial position and the drive motor 72 may be reversely rotated in a second direction opposite to the first direction. If it is determined that the push member 76 has returned to the initial position, the controller 30 may stop the drive motor 72.

Figure 12:
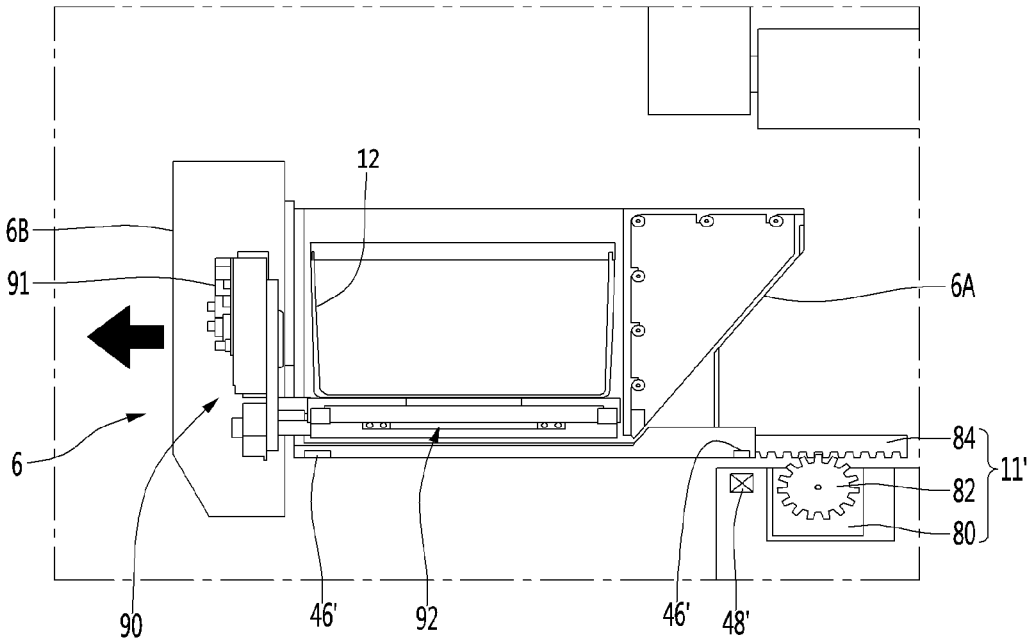
FIG. 12 is a cross-sectional view when another example of a door according to an embodiment of the present disclosure is opened by the door opening module.

FIG. 12 is a sectional view when another example of a door according to an embodiment of the present disclosure is opened by a door opening module.

The door opening module 11' illustrated in FIG. 12 may automatically open the door 6 disposed in the cabinet 1 to be capable of being advanced and retracted. The refrigerator may include a door having a high height and a door having low height, and the door opening module 11' may be installed to automatically open a door having a lower height than other doors. Such a door may be a retractable automatic door which is automatically opened by the door opening module 11'.

The door 6 advanced and retracted by the door opening module 11' may include a drawer body 6A and a door body 6B disposed at the drawer body 6A to open and close the storage chamber.

The door opening module 11' may include a drive motor 80, a pinion 82, and a rack 84. The pinion 82 may be connected to the rotation shaft of the drive motor 80. The rack 84 may extend from the door 6, in particular, the drawer body 6A.

The refrigerator may further include a door sensor that senses a position of the door 6, and the door sensor may sense a pair of magnets 46' spaced apart from the door 6 and a reed switch 48' sensing the magnet 46'.

When the power of the refrigerator is turned on, the controller 30 may wait to receive an opening command of the door 6.

When the door opening command is input through the input means, the controller 30 may transmit an opening signal to the drive motor 80.

The drive motor 80 may be rotated in the first direction by the controller 30 when an opening signal is input, and the pinion 82 and the rack 84 may transmit the rotational force of the drive motor 80 to the drawer body 82, the drawer body 6A may advance the door body 6B while advancing forward in the storage chamber, and the door body 6B can be advanced to be spaced apart from the cabinet 1 toward the front of the cabinet 1.

The controller 30 may sense that the door 6 has reached the opening position by the door sensor, and when the door 6 has reached the opening position, the controller 30 may stop the rotation of the drive motor 80.

When the drawer body 6A is advanced as described above, the upper surface of the drawer body 6A may be exposed.

In a state where the drawer body 6A is advanced to the opening position, the user can enter a door closing command such that the drawer body 6A retracts to the closing position via the input means. For example, if the motion sensed by the sensing unit 33 coincides with a specific motion, the controller 30 may transmit a close signal to the drive motor 80. The controller 30 may sense the proximity of the user by the proximity sensor 34, and transmit a closing signal to the drive motor 80 when the proximity sensor 34 detects that the user has moved more than a predetermined distance.

When the close signal is input, the drive motor 80 may be reversely rotated in a second direction opposite to the first direction. In reverse rotation of the drive motor 80, the pinion 82 and the rack 84 can transmit the rotational force of the drive motor 80 to the drawer body 6A, and while the drawer body 6A retracts into the storage chamber, the door body 6B can be retracted and the door body 6B can be retracted in close contact with the cabinet 1 toward the front of the cabinet 1.

The controller 30 may sense that the door 6 has reached the closing position by the door sensor, and if the door 6 has reached the closing position, the controller 30 may stop the rotation of the drive motor 80.

Figure 13:
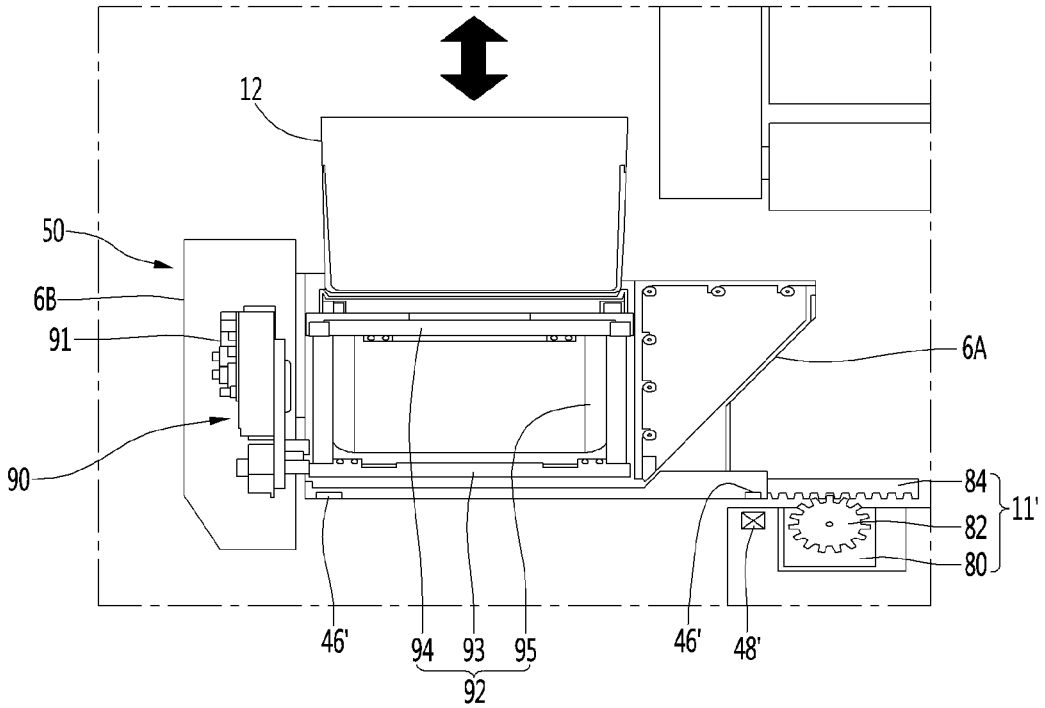
FIG. 13 is a sectional view when a holder illustrated in FIG. 12 is lifted.

FIG. 13 is a sectional view illustrating when the holder lifts in a state where the door is opened according to the embodiment of the present disclosure.

The refrigerator may further include a lifting module 13 that allows the holder 12 to automatically lift and lower in a state where the door 50 is open and the holder is moved a predetermined distance forward. The holder 12 may be a shelf, a drawer, a basket, or the like on which goods can be placed. The lifting module 13 may be disposed in the storage chamber or may be disposed on at least one of the rotatable door 5 and an advancing and retracting type door 6 for opening and closing the storage chamber. In the refrigerator, a high-height holder and a low-height holder may be disposed together.

The lifting module may be disposed in a storage chamber in which a holder having a lower height than other holders is located. The lifting module for lowering may be arranged in a storage chamber in which a holder having a relatively higher height than other holders is located.

As an example, the lifting module will be described.

The lifting module 13 may include a lower frame 93, an upper frame 94, an lifting and lowering mechanism 92 having at least one link 95, and a drive mechanism 90 capable of lifting and lowering the upper frame 94. The drive mechanism 90 may include a lifting and lowering motor 91 and a power transmission member connected to the lifting and lowering motor 91 to transfer the drive force of the lifting and lowering motor 91 to the upper frame 94.

When the power of the refrigerator is turned on, the controller 30 waits for a lifting command of the holder 12 to be input. When the lifting command is input through the input means, the controller 30 may transmit a lifting signal to the lifting and lowering motor 91 included in the lifting module 13.

When the controller 30 transmits an opening signal to the lifting and lowering motor 91, the upper frame 94 may lift, and the holder 12 may be lifted to the upper side of the drawer body 6B.

The user may input a lowering command through the input means, and the controller 30 may transmit a lowering signal to the lifting and lowering motor 91 when the lowering command is input through the input means.

The lifting and lowering motor 91 may be reversely rotated in a second direction opposite to the first direction. Upon reverse rotation of the lifting and elevating motor 91, the upper frame 94 may be lowered to the inner lower portion of the drawer body 82, and the holder 12 may be inserted into the drawer body 6B together with the upper frame 94.

Figure 14:
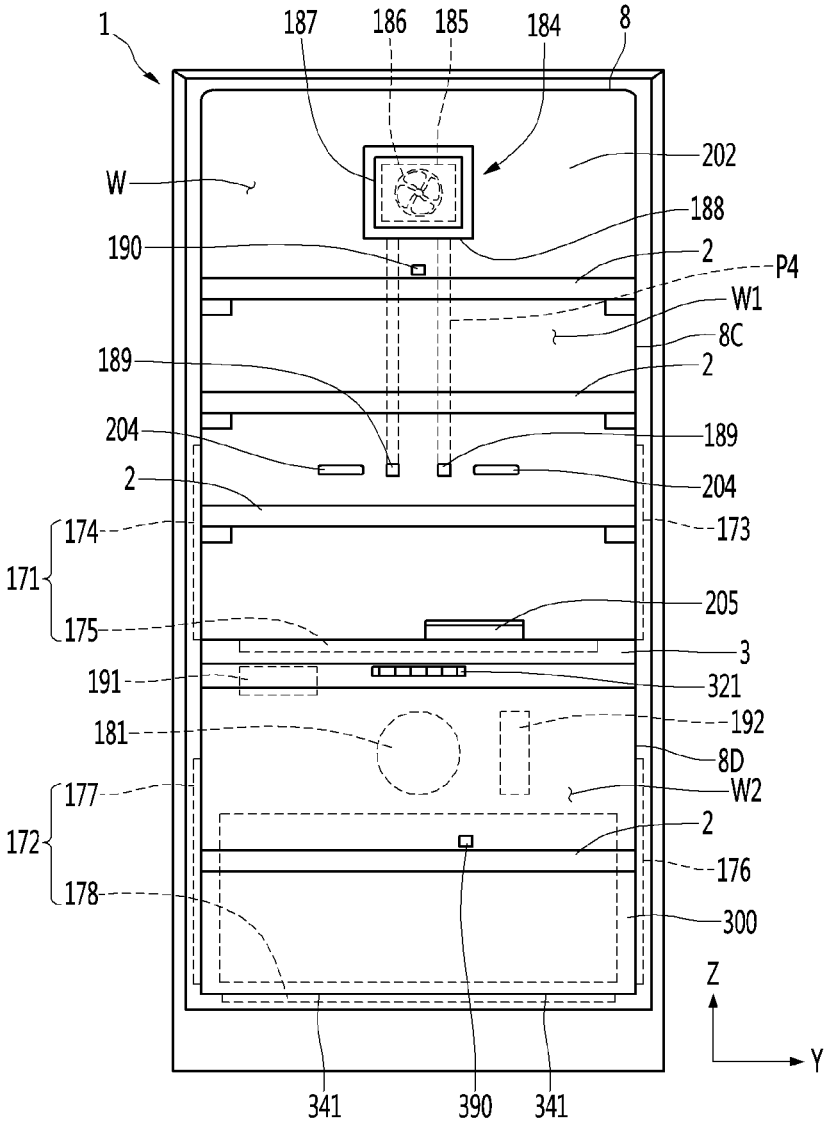
FIG. 14 is a front view illustrating a storage chamber of a refrigerator according to an embodiment of the present disclosure.
Figure 15:
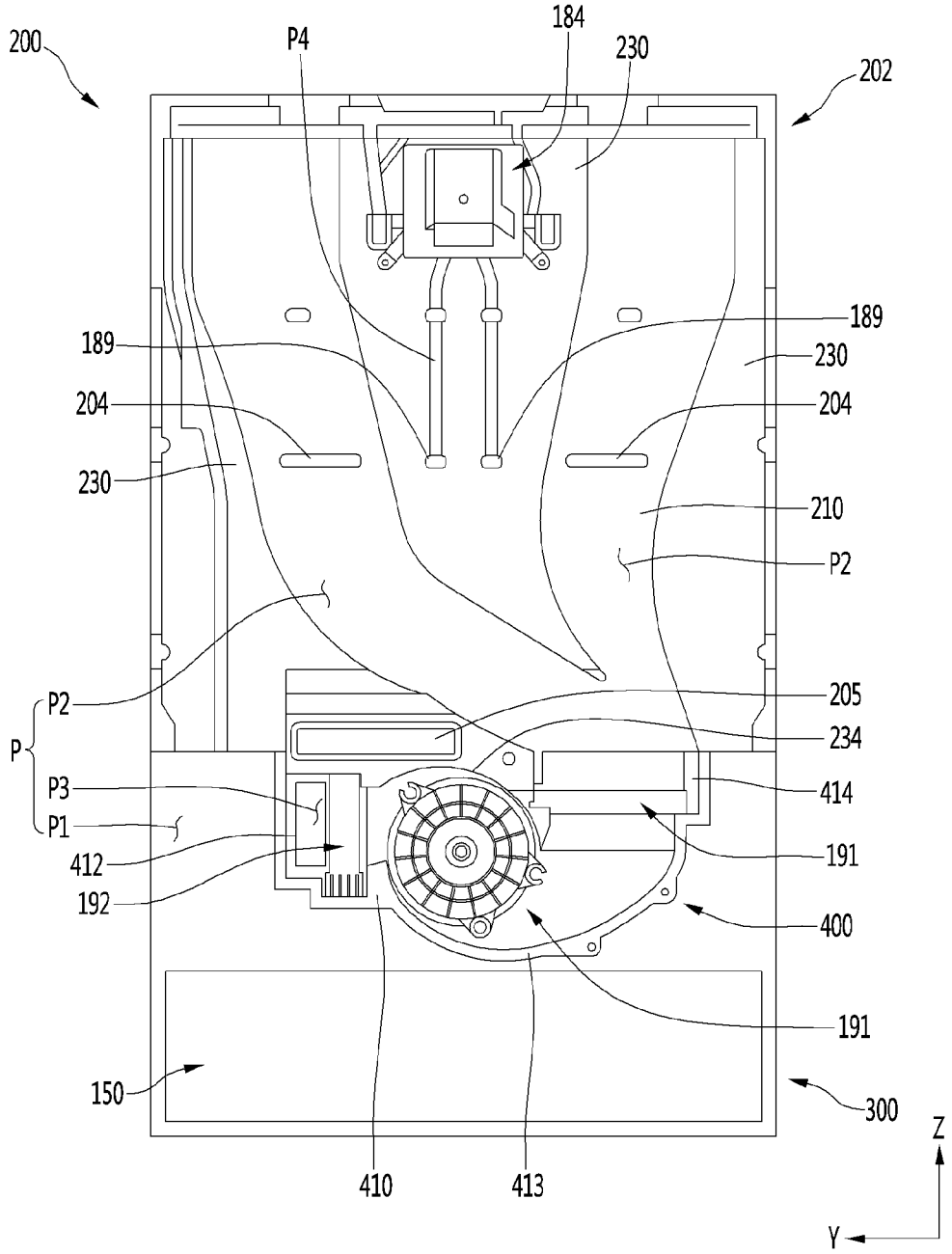
FIG. 15 is a rear view illustrating an inner portion of the inner guide according to an embodiment of the present disclosure.
Figure 16:
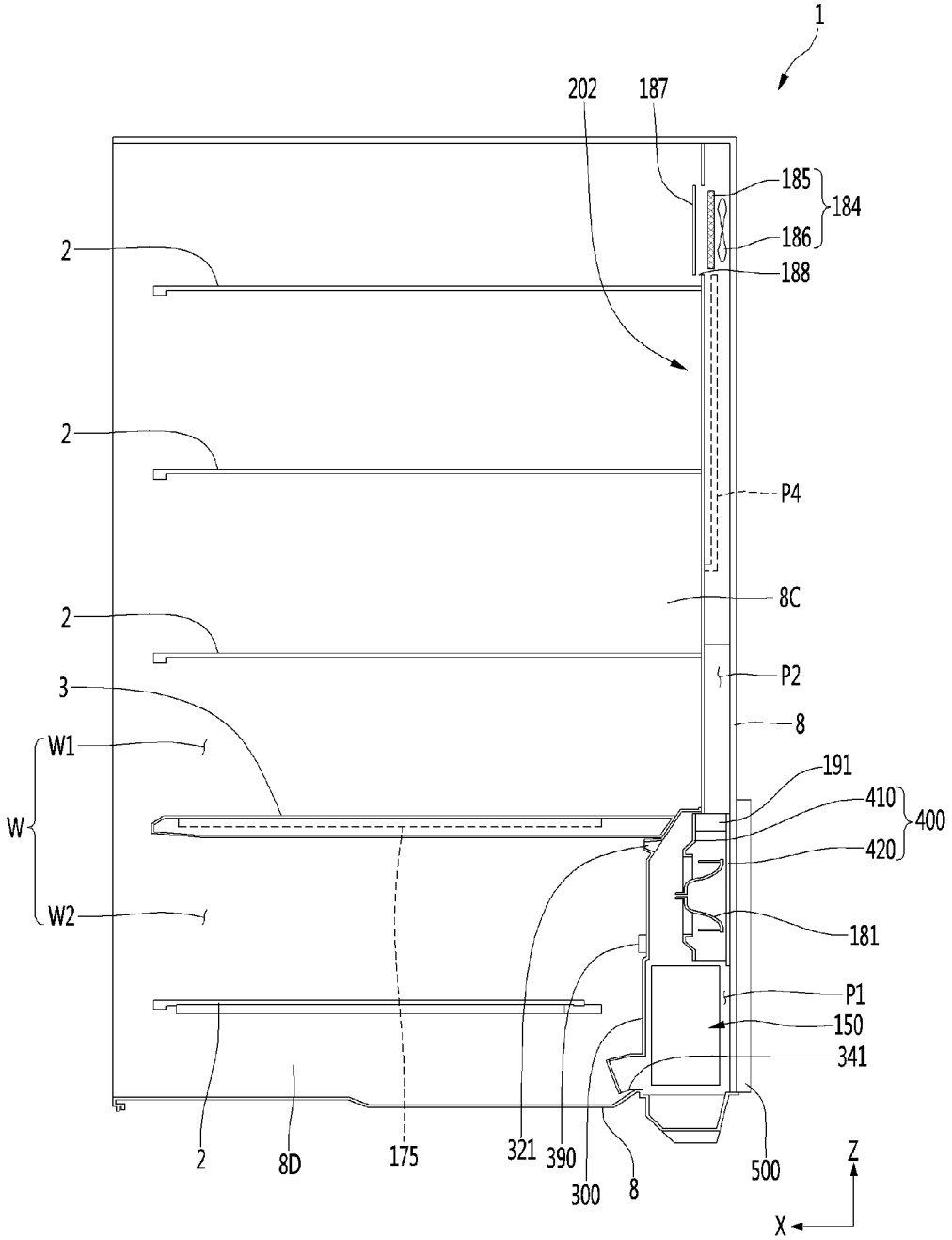
FIG. 16 is a sectional view of a refrigerator according to an embodiment of the present disclosure.

FIG. 14 is a front view illustrating a storage chamber of a refrigerator according to an embodiment of the present disclosure, FIG. 15 is a rear view illustrating an inner portion of the inner guide according to an embodiment of the present disclosure, and FIG. 16 is a sectional view illustrating a refrigerator according to an embodiment of the present disclosure.

The inner guide 200 may be disposed in the cabinet 1 in which the first storage chamber W is formed, and may be disposed in the inner case 8 to partition the storage space and the air flow path P.

The air flow path P may be formed between the inner guide 200 and the inner case 8 of the inner space of the inner case 8 or may be formed in the inner guide 200.

Hereinafter, although the temperature adjusting device disposed in the refrigerant flow path P will be described as an example of cooling means, the temperature adjusting device disposed in the air flow path P is not limited to being a cooling means, but may be a heating device such as a heater.

Meanwhile, for convenience, it will be described with reference to the same reference numeral 150 as the evaporator which can be an example for the temperature control device disposed in the air flow path P.

At least one fan 181, 186 may be disposed in the inner case 8 or the inner guide 200.

The fan 181 may be disposed in the inner guide 200 to circulate air in the storage space to the air flow path P and the storage space.

The circulation fan 186 may circulate air in the storage space and may be an HG fan.

The circulation fan 186 can be disposed in the circulation flow path P4, flow the air of the storage space into the circulation flow path P4 other than the air flow path P and blow the air of the circulation flow path P4 into the storage space.

The circulation flow path P4 may be formed to be partitioned from the air flow path P, and the circulation flow path P4 may be formed so that the air passing through the circulation flow path P4 is not mixed with the air passing through the air flow path P while passing through the circulation flow path P4. The circulation flow path P4 may be formed in the inner guide 200. The circulation flow path P4 may be formed in communication with the first space W1.

The fan 181 may be an inner airflow forming mechanism disposed in the air flow path P, and the circulation fan 186 may be an outer airflow forming mechanism disposed outside the air flow path P.

The inner guide 200 may form a storage space together with the inner case 8.

When the inner guide 200 is disposed in front of the rear body of the inner case 8, the storage space may be a space in front of the inner guide 200 among the inside of the inner case 8, and the air flow path P may be formed between the inner guide 200 and the rear body of the inner case 8 or may be formed inside the inner guide 200.

The inner guide 200 may cover the temperature adjusting device 150 and the fan 181.

Hereinafter, the detailed structure of the inner guide 200 is described.

The inner guide 200 may be formed to be spaced apart from the discharge port 204 and the suction port 205, and in a case where the refrigerator further includes a partition member 3, the partition member 3 may be closer to the lower end of the upper and lower ends of the storage chamber.

The discharge port 204 and the suction port 205 may be formed at a position facing the first space W1.

In a case where the discharge port 204 for discharging air into the first space W1 is the first discharge port, the additional discharge port 321 may be a second discharge port, and in a case where the suction port 205 where the air in the first space W1 is suctioned is a first suction port, the additional suction port 341 may be a second suction port.

One surface of the partition member 3 may be a suction guide surface for guiding air flowing toward the suction port 205, and the other surface of the partition member 3 may be a discharge guide surface for guiding air discharged to the additional discharge port 321.

When the partition member 3 is horizontally disposed in the storage space and the first space W1 is positioned above the second space W2, the discharge port 204 is an upper discharge port formed at a position higher than the additional discharge port 321 and additional suction port 341, and the additional discharge port 321 may be a lower discharge port. In addition, the suction port 205 may be an upper suction port formed at a position higher than the additional discharge port 321 and the additional suction port 341, and in this case, the additional suction port 341 may be a lower suction port.

Meanwhile, the inner guide 200 may be formed with a heat exchange flow path P1 in which the temperature adjusting device 150 and the fan 181 is received. The inner guide 200 may be formed with a discharge flow path P2 for guiding the air blown by the fan 181 to be discharged to the discharge port 204. The inner guide 200 may be provided with an additional discharge flow path P3 for guiding the air blown by the fan 181 to be discharged to the additional discharge port 321.

The heat exchange flow path P1, the discharge flow path P2, and the additional discharge flow path P3 may constitute an air flow path P for guiding air to circulate through the temperature adjusting device 150 and the storage space, and the temperature adjusting device 150 and the fan 181 may adjust the temperature of the first space W1 and the second space W2 in a state received in the air flow path P.

The air guide 400 may include a front housing 410 and a rear housing 420 in which the fan 181 is received. The air guide 400 may have an outlet 412 communicating with the additional discharge port 321. The outlet 412 may be formed to face the additional discharge port 321 to discharge air to the additional discharge port 321 or may be in communication with the additional discharge port 321 through a discharge duct (not illustrated).

The refrigerator may include a guide 234 for guiding air forced by the fan 181 inside the air guide 400 to the outlet 412. The guide 234 may be formed in the discharge guide 202 to guide the air blown from the fan 181 to the outlet 412.

The air guide 400 may be provided with a scroll 413 and an opening portion 414 for guiding air to the discharge flow path P2. The scroll 413 may guide the air blown from the fan 181 to the opening portion 414. The opening portion 414 may communicate with the lower end of the discharge flow path P2.

The first damper 191 may be disposed in the air flow path P and may adjust the air supplied to the first space W1. The first damper 191 may be mounted to be positioned between the fan 181 and the discharge port 204 in the air flow direction.

The second damper 192 may be disposed in the air flow path P and may adjust the air supplied to the second space W2. The second damper 192 may be mounted between the fan 181 and the additional discharge port 321 in the air flow direction.

The circulation fan 186 may be disposed in the inner guide 200. In the inner guide 200, when the circulation fan 186 is operated, a circulation flow path P4 through which air flowing by the circulation fan 186 passes may be formed. When the circulation fan 186 is driven, the inner guide 200 may have an inlet 188 through which air in the storage space flows into the circulation flow path P4. The inner guide 200 may have an outlet 189 through which air from the circulation flow path P4 is discharged into the storage space.

The inlet 188 and the outlet 189 may communicate with the first space W1 and may be formed to face the first space W1. The circulation fan 186 may circulate air in the first space W1 into the circulation flow path P4 and the first space W1.

A purifying unit 185 such as an air purifying filter may be disposed in the circulation flow path P4, and the air passing through the circulation flow path P4 may be purified by the purification unit 185.

The inner guide 200 may further include a discharge guide 202 and an inlet body 187 forming the inlet 188.

The inner guide 200 may be provided with a first temperature sensor 190 for sensing the temperature of the first space W1 and a second temperature sensor 390 for sensing the temperature of the second space W2.

The inner guide 200 may include a discharge guide 202 and an inner cover 300.

The discharge guide 202 may be disposed higher than the inner cover 300.

The temperature adjusting device 150 and the fan 181 pass through the air flow path P formed by at least one of the discharge guide 202 and the inner cover 300 to supply air to the first space W1 and the second space W2.

The temperature adjusting device 150 may be received in the inner cover 300.

The discharge guide 202 and the inner cover 300 are configured to be received inside the inner case 8 together with the temperature adjusting device 150 and the fan 181, and the discharge guide 202, the inner cover 300, and the temperature adjusting device 150 and fan 181 preferably minimize the volume occupied in its entirety.

The fan 181 is to forcedly flow the air heat exchanged with the temperature adjusting device 150, and the air flowing by the fan 181 can discharge and guide to the first space W1 and the second space W2 by the discharge guide 202 and the inner cover 300.

The discharge guide 202 may face the first space W1, and the discharge guide 202 may be formed with the discharge port 204 and the suction port 205.

The inner cover 300 may be connected to the discharge guide 202. The inner cover 300 may face the second space W2, and the inner cover 300 may be formed with the additional discharge port 321 and the additional suction port 341.

One surface of the discharge guide 202 may face the first space W1, and the discharge port 204 and the suction port 205 may be formed in an area of the discharge guide 202 facing the first space W1.

The HG module 184 (heating air generation module) for purifying the air in the first space W1 and the first temperature sensor for sensing the temperature of the first space W1 may be provided in a portion of the discharge guide 202 facing the first space W1.

The HG module 184 may include a circulation fan 186. The HG module 184 may include a purifying unit 185 such as an air purifying filter.

One surface of the inner cover 300 may face the second space W2, and the additional discharge port 321 and the additional suction port 341 may be formed in an area of the inner cover 300 facing the second space W2. The height of the additional discharge port 321 may be higher than the height of the additional suction port 341.

The additional discharge port 321 may be formed on the inner cover 300, and the air blown by the fan 181 may be discharged into the second space W2 through the additional discharge ports 321.

An additional suction port 341 may be formed below the inner cover 300. The air suctioned into the additional suction port 341 may flow to the temperature adjusting device 150.

A portion of the inner cover 300 facing the second space W2 may be provided with a second temperature sensor 390 which senses the temperature of the second space W2.

Meanwhile, the refrigerator may include at least one heating device for heating the storage space, and the refrigerator may perform the heating mode H (see FIG. 4) using the heating device.

At least one heating device may be operated independently from the temperature adjusting device 150 disposed in the air flow path P.

The refrigerator may perform the cooling mode E (see FIG. 4) by the temperature adjusting device 150 disposed in the air flow path P, and perform the heating mode H by the at least one heating device.

The heating device may include first heating means 171, 172 capable of heating the storage chamber by conduction and radiation, and second heating means 186 capable of heating the storage chamber by convection. The first heating means may be disposed to heat only one of the first space W1 and the second space W2 and may be provided for each of the first space W1 and the second space W2.

In consideration of energy efficiency or the like, the first heating means is preferably installed at a position that is thermally separated from the temperature adjusting device disposed in the air flow path P. The first heating means may be disposed in addition to the air flow path P. The first heating means may be disposed in addition to the inner guide forming the air flow path P. The first heating means may be disposed other than a surface of the inner case that directly faces the inner guide (for example, when the inner guide is disposed behind the storage chamber, the surface of the inner case that faces the inner guide and forms the rear of the storage chamber).

Meanwhile, the first heating means 171 may be disposed to heat the region of the first space W1 relatively easy to supercool than other regions. Air discharged from the discharge ports 204 and 321 into the storage chamber space may fall and be suctioned through the suction ports 205 and 341, and an area close to the suction ports 205 and 341 in the storage space may be an area which is relatively and easily supercooled down than an area far from the suction ports 205 and 341. The first heating means may be disposed to heat more of the storage space adjacent to the suction port than the storage space adjacent to the discharge port. For example, the heating means 171 for the first space W1 may be disposed below the inner case forming the first partition member 3 and the first space. For example, the heating means 172 for the second space W2 may be disposed in an inner case forming a second space with the second partition member 10. The heating means 172 for the second space W2 may be installed in an inner case positioned between the first partition member 3 and the second partition member 10. Meanwhile, the second heating means 186 is preferably installed as far as possible from the first heating means (171, 172) in order to increase the circulation efficiency by convection. The second heating means 186 may be disposed closer to the discharge ports 204 and 321 than to the suction ports 205 and 341. The first heating means 171, 172 may be located below the storage chamber, and the second heating means 186 may be located above the storage chamber. The second heating means 186 may be located above the partition wall 3, and the cooling means 150 may be located below the partition wall 3. The second heating means 186 may be located above the inner guide 200, and the cooling means 150 may be located below the inner guide 200. The circulation flow path P4 for the second heating means 186 formed in the inner guide 200 and the air flow path P for the cooling means 150 may be partitioned by a heat insulating body.

The heating device 171 may include a pair of first side heating devices 173 and 174 disposed on the first body 8C. The heating device 171 may include an inner heating device 175 disposed on the partition member 3 or the shelf 2.

The inner heating device 175 is disposed to be exposed to an outer surface of the partition member 3, the shelf 3 or the heating body to directly heat the air in the storage space.

If the heating device 171 includes a pair of first side heating devices 173 and 174 and an inner heating device 175, preferably, the capacity of each of these heating devices 173, 174, and 175 is properly distributed.

The total capacity of the heating device 171 may be the sum of the capacity of each of the pair of first side heating devices 173 and 174 and the capacity of the inner heating device 175, and it is preferred that the capacity of the inner heating device 175 is 30% or more of the total capacity of the heating device 171. In addition, the capacity of the inner heating device 175 may be greater than the capacity of the pair of first side heating devices 173 and 174. In addition, the sum of the capacities of the pair of first side heating devices 173 and 174 is preferably 31.25% to 56.26% of the total capacity.

The refrigerator may further include an additional heating device 172 for heating the second space W2. The additional heating device 172 may include a pair of second side heating devices 176 and 177 disposed on the second body 8D. The additional heating device 172 may further comprise a lower heating device 178 disposed on the lower body of the inner case 8.

If the additional heating device 172 includes both a pair of second side heating devices 176 and 177 and a lower heating device 178, preferably, the capacity of each of these heating devices 176, 177 and 178 is properly distributed.

The total capacity of the additional heating device 172 may be the sum of the capacity of each of the pair of second side heating devices 176 and 177 and the capacity of the lower heating device 178, and preferably, the capacity of the lower heating device 178 is 30% or more of the total capacity of the additional heating device 172. In addition, the capacity of the lower heating device 178 may be greater than the capacity of the pair of second side heating devices 176 and 177. In addition, preferably, the sum of the capacities of the pair of second side heating devices 176 and 177 is 31.25% to 56.26% of the total capacity of the additional heating devices 172.

In the cooling mode of the first space W1, the cooling means and the fan 181 may be operated, and the heating device 171 may be stopped. In this case, the cooling means may be controlled by the flow path switching mechanisms 120 and 120', the compressor 100, and the like so that the refrigerant is supplied to the temperature adjusting device 150, and the first damper 191 may be opened.

In the heating mode of the first space W1, the heating device 171 may be operated. In this case, at least one of the fan 181 and the circulation fan 186 may be operated.

In the heating mode of the first space W1, the circulation fan 186 is driven so that the air in the first space W1 circulates through the heating device 171 and the circulation flow path P4, and the first space W1 can be heated by convection. In this case, the cooling means may be controlled so that the air of the air flow path P is not discharged into the first space W1, and thus the first damper 191 may be closed or the fan 181 may be stopped.

In the heating mode of the first space W2, the fan 181 is operated so that the air in the first space W1 circulates through the heating device 171 and the air flow path P, and the first space W1 can be heated by convection. In this case, the cooling means may control the flow path switching mechanism 120, 120' and the compressor 100 such that the refrigerant is not supplied to the temperature adjusting device 150.

In the cooling mode of the second space W2, the cooler and the fan 181 may be operated, and the additional heating device 172 may be stopped. In this case, the cooling means may be controlled by the flow path switching mechanisms 120 and 120', the compressor 100, and the like so that the refrigerant is supplied to the temperature adjusting device 150, and the second damper 192 can be opened.

In the heating mode of the second space W2, the additional heating device 172 may be operated. In this case, the fan 181 may be activated or stopped.

In the heating mode of the second space W2, the fan 181 is operated so that the air in the second space W2 circulates through the additional heating device 172 and the air flow path P, and the second space W2 can be heated by convection. In this case, the cooling means may control the flow path switching mechanism 120, 120' and the compressor 100 such that the refrigerant is not supplied to the temperature adjusting device 150.

In the heating mode of the second space W2, the fan 181 may be stopped, and in this case, the additional heating device 172 may heat the second space W2 by conduction.

If the first space W1 is the cooling mode and the second space W2 is the cooling mode, the compressor 100 can be operated, and the flow path switching mechanisms 120 and 120' may guide refrigerant to the temperature adjusting device 150, both the first damper 191 and the second damper 192 may be opened, and the fan 181 may be driven. The air in the storage space may circulate through the temperature adjusting device 150 and the storage space, and the storage space may be cooled by convection.

If the first space W1 is the cooling mode and the second space W2 is the heating mode or the standby mode, the compressor 100 may be operated, the flow path switching mechanisms 120 and 120' may guide refrigerant to a temperature adjusting device 150, the first damper 191 may be opened, the second damper 192 may be closed, and the fan 181 may be driven. If the fan 181 is driven, the air in the first space W1 may be cooled by the convection while circulating the temperature adjusting device 150 and the first space W1.

If the first space W1 is in the cooling mode and the second space W2 is in the heating mode, the additional heating device 172 may be operated, and the second space W2 may be heated by the additional heating device 172. On the other hand, if the first space W1 is the cooling mode and the second space W2 is the standby mode, the additional heating device 172 may be stopped.

In an example in which the first space W1 is the heating mode and the second space W2 is the heating mode, the heating device 171 and the additional heating device 172 may be operated, the circulation fan 186 may be operated, the compressor 100 is not operated or the flow path switching mechanisms 120 and 120' do not guide the refrigerant to the temperature adjusting device 150, the first damper 191 may be closed, the second damper 192 may be opened, and the fan 181 may be operated. When the circulation fan 186 is operated, the air in the first space W1 may be heated by the convection while circulating the heating device 171 and the circulation flow path P4. In addition, when the fan 181 is operated, the air in the second space W2 may be heated by the convection while circulating the additional heating device 172 and the air flow path P.

In another example in which the first space W1 is the heating mode and the second space W2 is the heating mode, the heating device 171 and the additional heating device 172 may be operated, the circulation fan 186 may be operated, the compressor 100 is not operated or flow path switching mechanisms 120 and 120' do not guide the refrigerant to the temperature adjusting device 150, the first damper 191 and the second damper 192 may be closed, and the fan 181 may be stopped. When the circulation fan 186 is driven, the air in the first space W1 may be heated by the convection while circulating the heating device 171 and the circulation flow path P4. In addition, the second space W2 may be heated by an additional heating device 172.

In another example in which the first space W1 is the heating mode and the second space W2 is the heating mode, the heating device 171 and the additional heating device 172 may be operated, the compressor 100 is not operated or the flow path switching mechanisms 120 and 120' do not guide the refrigerant to the temperature adjusting device 150, the first damper 191 and the second damper 192 may be opened, and the fan 181 may be driven. In this case, the air in the storage space may be heated by the convection while circulating the heating device 171, the additional heating device, and the air flow path P.

In an example in which the first space W1 is the heating mode and the second space W2 is the cooling mode, the heating device 171 is operated, the compressor 100 is operated, the flow path switching mechanisms 120 and 120' may guide the refrigerant to the temperature adjusting device 150, the first damper 191 may be closed, the second damper 192 may be opened, and the circulation fan 186 and the fan 181 may be driven. When the circulation fan 186 is driven, the air in the first space W1 may be circulated through the heating device 171 and the circulation flow path P4, and the first space W1 may be heated by convection. In addition, when the fan 181 is driven, the air in the second space W2 may be circulated through the temperature adjusting device 150 and the second space W2, and the second space W2 may be cooled by convection.

In another example in which the first space W1 is the heating mode and the second space W2 is the cooling mode, the heating device 171 is operated, the compressor 100 is not operated, or the flow path switching mechanisms 120 and 120' do not guide the refrigerant to the temperature adjusting device 150, the first damper 191 may be opened, the second damper 192 may be closed, and the fan 181 may be driven. When the fan 181 is driven, the air in the first space W1 may circulate through the heating device 171 and the air flow path P, and the first space W1 may be heated by convection. In this case, the refrigerator may perform the heating mode of the first space W1 before to the cooling mode of the second space W2, and the deterioration of the quality of the goods stored in the first space W1 may be minimized.

In an example in which the first space W1 is the heating mode and the second space W2 is the standby mode, the heating device 171 may be operated, the compressor 100 may not be operated, or the flow path switching mechanisms 120 and 120' do not guide the refrigerant to the temperature adjusting device 150, the first damper 191 and the second damper 192 may be closed, and the circulation fan 186 may be operated. In this case, when the circulation fan 186 is operated, the air in the first space W1 may be heated by the convection while circulating the heating device 171 and the circulation flow path P4.

In another example in which the first space W1 is the heating mode and the second space W2 is the standby mode, the heating device 171 may be operated, the compressor 100 is not operated, or the flow path switching mechanisms 120 and 120' do not guide the refrigerant to the temperature adjusting device 150, the first damper 191 may be opened, the second damper 192 may be closed, and the circulation fan 186 may be operated. When the circulation fan 186 is operated, the air in the first space W1 may be heated by convection while circulating through the heating device 171 and the air flow path P.

The controller 30 may selectively perform a plurality of modes E, H, and D according to the input means, the timer 37, and the temperature sensors 190 and 390.

The controller 30 may adjust the temperature of the first space W1 to the cooling mode or the heating mode or maintain the temperature of the first space W1 to the standby mode according to the target temperature of the first space W1 input through the input means, the temperature detected by the first temperature sensor 190, and the time counted by the timer 37.

The controller 30 may control the second space W2 in the cooling mode, the standby mode, and the heating mode. The controller 30 may adjust the temperature of the second space W2 to the cooling mode or the heating mode or maintain the temperature of the second space W2 to the standby mode according to the target temperature of the second space W2 input through the input means, the temperature detected by the second temperature sensor 390, and the time counted by the timer 37.

Hereinafter, to avoid overlapping description, the space in which the temperature is adjusted by the cooling means and the heating means is referred to as a storage chamber W, and the temperature of the storage chamber W is described as being sensed by the temperature sensor 190, and the fan 181 and the circulation fan 186 will be described as an example of the airflow forming mechanism for flowing air in the storage chamber, the temperature adjusting device 150 will be described as a component of the cooling means, and the heating device 171 is described as a component for heating the storage chamber.

Hereinafter, the switching between the cooling mode by the cooling means and the heating mode by the heating means will be described in detail with reference to FIGS. 4, 17 and 18.

Figure 17:
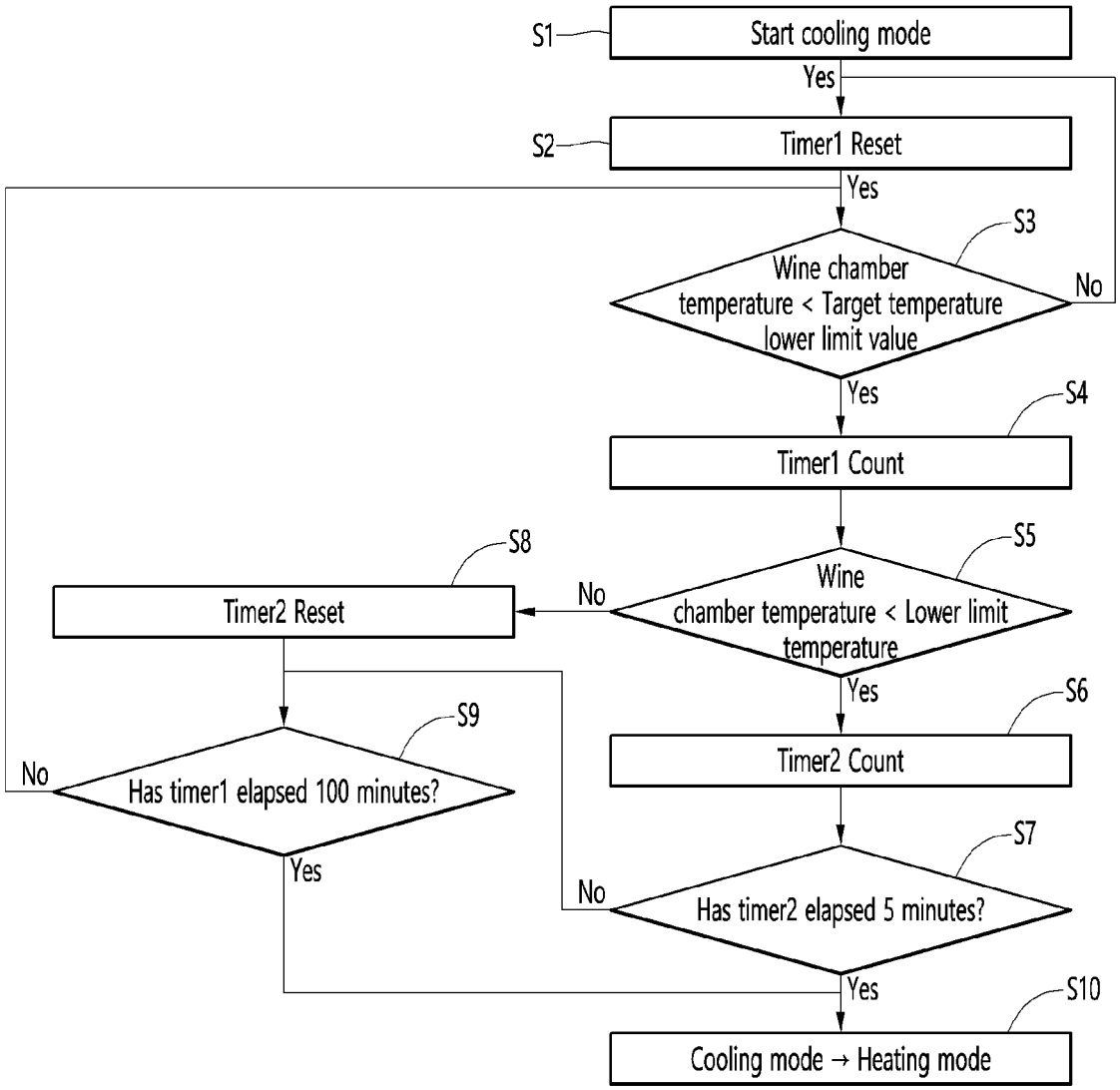
FIG. 17 is a flow chart when the refrigerator is switched to the heating mode from the cooling mode according to an embodiment of the present disclosure.

FIG. 17 is a flow chart when the refrigerator is switched from the cooling mode to the heating mode according to an embodiment of the present invention.

In some cases, the greater the temperature change inside the storage chamber, the lower the quality of the goods stored in the storage chamber. The amount of temperature change in the storage chamber can be considered in two aspects.

First, it is possible to measure a temperature change amount over time (hereinafter, referred to as a time-temperature change amount) based on a specific point in storage space. For example, the time-temperature change amount means a difference value between the first temperature in the upper space of the storage chamber at the first time and the second temperature in the upper space of the storage chamber at the second time which differs from the first time.

Second, it is possible to measure the temperature change amount according to the location of the storage space (hereinafter, referred to as a space-temperature change amount) based on the same time. For example, the space-temperature change amount means a difference between the first temperature in the upper space of the storage chamber and the second temperature in the lower space of the storage chamber at the same time.

As a method for reducing the time, temperature change amount in the storage chamber, it is also possible to set to reduce the difference between the target temperature upper limit value and the target temperature lower limit value (hereinafter, referred to as storage temperature difference). In this case, due to the frequent on/off of the temperature adjusting device, there are disadvantages that the reliability of the components is reduced and the power consumption may increase.

In another method, the above problem can be reduced by using a temperature adjusting device including cooling means and heating means. In particular, it is preferable that the cooling means and the heating means are provided to control the temperature of at least one of the expensive specific goods storage chamber, the constant temperature chamber, and the priority storage chamber of the refrigerator. For example, if at least some of the heating means are temporarily disabled/malfunctioned, the target temperature of the storage chamber is controlled to be increased (or decreased), or the door is opened, resulting in excessive inflow of outside air lower (or higher) than the inside of the refrigerator, the temperature of the storage chamber can be supercooled (or overheated). As a result, the heating means (or cooling means) may be operated to improve or maintain the quality of the stored product.

Meanwhile, since the cooling means and the heating means perform opposite functions in terms of maintaining the storage chamber temperature, it is preferable that the cooling means and the heating means are separated/partitioned in terms of insulation in order to reduce power consumption, and in terms of control, it is preferable to control the operation of the cooling means and the heating means so as not to overlap each other. For this purpose, it is preferable to alternately operate the cooling means and the heating means. Meanwhile, when the operation starting condition of the predetermined heating means is satisfied after the cooling means is ended, it is preferable to give a time difference rather than immediately start the operation of the heating means. This is because in a case where the sensor measurement fluctuates when the temperature sensor of the storage chamber measures the temperature of the storage space, or the door is opened frequently for a short time and thus the temperature of the storage chamber changes suddenly, if the temperature adjusting device is operated immediately, disadvantages that the component reliability is reduced and power consumption is increased due to the frequent on/off of the temperature adjusting device may be generated.

Meanwhile, it is very difficult to set this time difference fixedly. this is because it is almost impossible to set the time difference uniformly since the situation in which the switching between the cooling means and the heating means should occur is very diverse. Therefore, the greater the difference between the temperature of the storage chamber and the target temperature of the storage chamber, the greater the likelihood of deterioration of the stored product, and therefore, the time difference is preferably set shorter. In a case where the heating means is operated, for example, when the temperature of the storage chamber reaches the target temperature lower limit value (T4° C.), the heating means is operated after the first time T1 has elapsed, and when the temperature of the storage chamber reaches the temperature (T5° C.) lower than the target temperature lower limit value (T4° C.), it is preferable to allow the heating means to operate after the second time (T2, T2<T1) has elapsed. Of course, when the temperature of the storage chamber reaches a temperature (T6° C.) lower than the temperature (T5° C.) it may be able to operate the heating means after the third time (T3, T3<T2) has elapsed.

If power is applied to the refrigerator, the controller 30 may compare the storage chamber temperature sensed by the temperature sensor 190 (hereinafter, referred to as a storage chamber temperature) with an upper limit value of the target temperature, and if the storage chamber temperature is higher than the upper limit value of the target temperature the controller 30 can start the cooling mode E (S1).

The controller 30 may reset the first timer of the timer 37 when the cooling mode E starts. Here, the first timer may be a term for distinguishing the first timer from the second timer to be described later. The timer 37 may include the first timer and the second timer. A start time at which the first timer starts counting time and a start time at which the second timer starts counting time may be different from each other.

The controller 30 may operate the temperature adjusting device 150 in the cooling mode E and operate the fan 181. Here, the operation of the temperature adjusting device 150 may mean to operate the refrigerator to supply the refrigerant to the temperature adjusting device 150, for example, mean the operation of the compressor 100 or mean that the flow path switching mechanism 120, 120' guides the refrigerant to the temperature adjusting device 150.

The air in the storage chamber W may cool the storage chamber W while circulating the storage chamber W and the temperature adjusting device 150, and the storage chamber temperature may be gradually lowered by the temperature adjusting device 150.

The controller 30 may stop the temperature adjusting device 150 if the storage chamber temperature is less than the lower limit value of the target temperature. Here, the stop of the temperature adjusting device 150 may mean to operate the refrigerator so that the refrigerant is not supplied to the temperature adjusting device 150, for example, mean the stop of the compressor 100 or mean that the flow path switching mechanism 120, 120' does not supply the refrigerant to the temperature adjusting device 150.

When the temperature adjusting device 150 is stopped, the storage chamber temperature may be increased again above the target temperature lower limit value or maintained between the target temperature lower limit value and the lower limit temperature, or lower than the lower limit temperature according to the load.

The controller 30 may count the first timer of the timer 37 if the storage chamber temperature is less than the lower limit value of the target temperature (S3) (S4). Here, it may mean that the timer 37 counts the time for which the storage chamber temperature maintains a temperature less than the lower limit value of the target temperature. The refrigerator may count a time (hereinafter, referred to as first time) when the storage chamber temperature is less than the lower limit value of the target temperature using the timer 37.

The controller 30 may compare the storage chamber temperature with the lower limit temperature, and reset the second timer of the timer 37 if the storage chamber temperature is equal to or higher than the lower limit temperature (S5) (S8). The controller 30 can compare the first time counted by the timer 37 with the first set time (for example, 100 minutes), and the controller 30 can start if the first time counted by the timer 37 is higher than the first set time (for example, 100 minutes) (S9) (S10).

Meanwhile, the controller 30 does not start the heating mode H and can compare again the storage chamber temperature with the target temperature lower limit value if the first time is equal to or less than the first set time (for example, 100 minutes), as a result of the comparison of the first time with the first set time (for example, 100 minutes) (S9) (S3).

Meanwhile, the controller 30 may reset the first timer of the timer if the storage chamber temperature is equal to or higher than the target temperature lower limit value (S3) (S2).

Meanwhile, if the storage chamber temperature is less than the lower limit value of the target temperature and less than the lower limit temperature, the controller 30 may count the second timer of the timer 37 (S3) (S5) (S6). Here, the counting of the second timer may mean that the timer 37 counts the time for which the storage chamber temperature is maintained below the lower limit temperature.

The refrigerator may count a time (hereinafter, referred to as a second time) for which the storage chamber temperature is less than the lower limit temperature using the timer 37.

The controller 30 may start the heating mode H if the second time is greater than the second set time as a result of the comparison of the second time with the second set time (for example, 5 minutes) (S7) (S10).

The controller 30 may compare the first time with the first set time if the second time is equal to or less than the second set time, and start the heating mode H if the first time is greater than the first set time (S7) (S9) (S10). Meanwhile, if the second time is equal to or less than the second set time and the first time is equal to or less than the first set time, the controller 30 does not start the heating mode H and can compare the storage chamber temperature and the lower limit value of the target temperature (S7) (S9) (S3).

In other words, after the end of the cooling mode E, if the time for which the storage chamber temperature maintains between the target temperature lower limit value and the lower limit temperature is higher than the first set time (for example, 100 minutes) or the time for which the storage chamber temperature maintains a temperature less than the lower limit temperature is greater than the second set time (for example, 5 minutes), the refrigerator can start the heating mode H.

The refrigerator may be in a standby mode D during a first set time for which the storage chamber temperature maintains the target temperature lower limit value and a lower limit temperature, and the refrigerator may be in standby mode D during a second set time for which the storage chamber temperature maintains the lower temperature.

Upon start of the heating mode H, the controller 30 may operate the heating device 171, may operate the circulation fan 186 and/or the fan 181, and the temperature of the storage chamber may be gradually raised by the operation of the heating device 171 and the operation of the circulation fan 186 and/or the fan 181.

Figure 18:
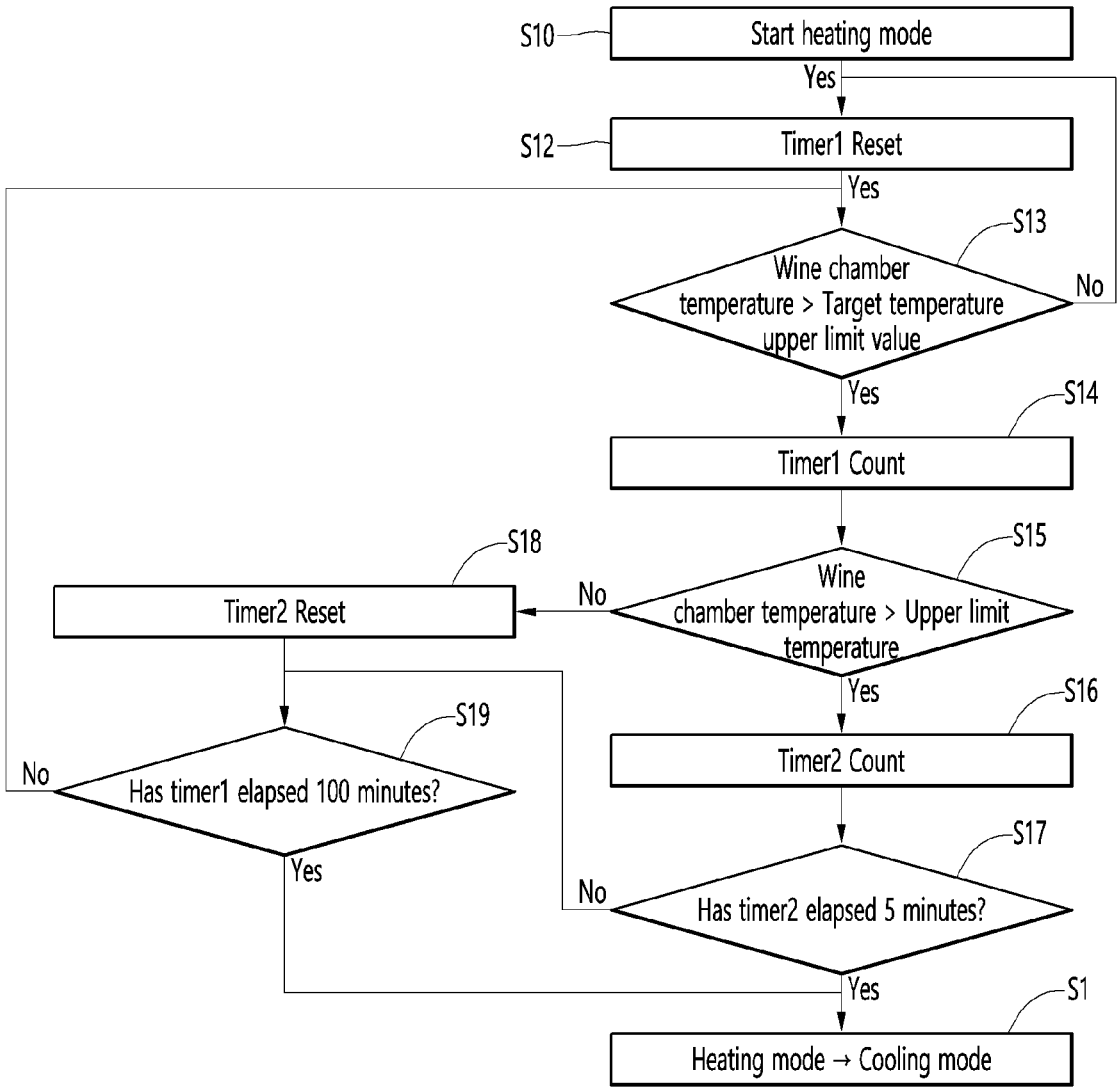
FIG. 18 is a flowchart when the refrigerator is switched from the heating mode to the cooling mode according to an embodiment of the present disclosure.

FIG. 18 is a flowchart when the refrigerator is switched from the heating mode to the cooling mode according to an embodiment of the present disclosure.

The controller 30 may reset the first timer of the timer 37 at the start of the heating mode H (S12). Here, the first timer may be a term used to distinguish the first timer from the second timer. The timer 37 may include a first timer and a second timer. A start time at which the first timer starts counting time and a start time at which the second timer starts counting time may be different from each other.

The controller 30 may operate the heating device 171 in the heating mode H and may operate the circulation fan 186 and/or the fan 181. Here, the operation of the heating device 171 may mean that the temperature of the heating device 171 is raised so that the heating device 171 raises the ambient temperature, for example, may mean the operation (on) of the heater.

The air in the storage chamber W may heat the storage chamber W while circulating the storage chamber W and the heating device 171, and the storage chamber temperature may be gradually increased by the heating device 171.

The controller 30 may stop the heating device 171 if the storage chamber temperature is higher than the upper limit value of the target temperature. Here, the stop of the heating device 171 may mean to cut off the current applied to the heating device 171, for example, may mean the stop (off) of the heater.

If the heating device 171 is stopped, the storage chamber temperature may increase again below the target temperature upper limit value, maintain between the target temperature upper limit value and the upper limit temperature, or be lower than the upper limit temperature, according to the load.

The controller 30 may count the first timer of the timer 37 if the storage chamber temperature is higher than the upper limit value of the target temperature (S13) (S14). Here, the counting of the first timer may mean that the timer 37 counts the time for which the storage chamber temperature maintains a temperature which is higher than the upper limit value of the target temperature. The refrigerator may count a time (hereinafter, referred to as first time) for which the storage chamber temperature is higher than the upper limit value of the target temperature by using the timer 37.

The controller 30 may compare the storage chamber temperature with the upper limit temperature and reset the second timer of the timer 37 if the storage chamber temperature is higher than the upper limit temperature (S15 (S18). In addition, the controller 30 can compare the first time counted by the timer 37 with the first set time (for example, 100 minutes), and the controller 30 can start the cooling mode E if the first time counted by the timer 37 is higher than the first set time (for example, 100 minutes) (S19) (S1).

On the other hand, the controller 30 does not start the cooling mode E and can compare again the storage chamber temperature with the target temperature upper limit value if the first time is equal to or less than the first set time (for example, 100 minutes) as a result of the comparison of the first time with the first set time (S19) (S13).

Meanwhile, the controller 30 may reset the first timer of the timer if the storage chamber temperature is equal to or less than the target temperature upper limit value (S13) (S12).

Meanwhile, the controller 30 may count the second timer of the timer 37 if the storage chamber temperature is higher than the upper limit value of the target temperature and lower than the upper limit temperature (S13) (S15) (S16). The counting of the second timer may mean that the timer 37 counts the time for which the storage chamber temperature maintains above the upper limit temperature.

The refrigerator may count a time (hereinafter, referred to as a second time) for which the storage chamber temperature is higher than the upper limit temperature using the timer 37.

The controller 30 may start the cooling mode E if the second time is greater than the second set time, for example, 5 minutes) as a result of the comparison of the second time with the second set time (S17) (S1).

The controller 30 may compare the first time with the first set time if the second time is equal to or less than the second set time, and start the cooling mode E if the first time is greater than the first set time (S17) (S19) (S1). Meanwhile, if the second time is equal to or less than the second set time and the first time is equal to or less than the first set time, the controller 30 does not start the cooling mode E and can compare the storage chamber temperature with the target temperature upper limit value (S17) (S19) (S13).

In other words, in the refrigerator, after the end of the heating mode H, the refrigerator can start the cooling mode E if the time for which the storage chamber temperature maintains between the upper limit value of the target temperature and the upper limit temperature is greater than the first set time (for example, 100 minutes) or the storage chamber temperature maintains a temperature which is higher than the upper limit temperature.

The refrigerator may be in the standby mode D during a first set time for which the storage chamber temperature maintains between the upper limit value of the target temperature and the upper limit temperature, and in the standby mode (D) during the second set time for which the storage chamber temperature maintains a temperature which is higher than the upper limit temperature.

Figure 19:
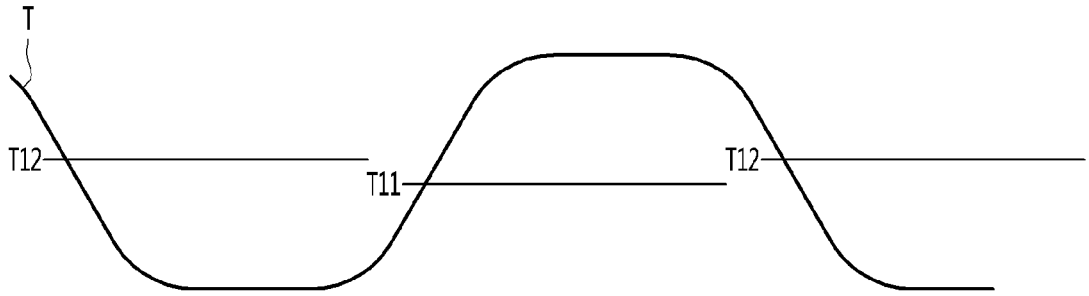
FIG. 19 is a view illustrating an example of a heating mode and a cooling mode according to a change in temperature of a storage chamber according to an embodiment of the present disclosure.

FIG. 19 is a view illustrating an example of a heating mode and a cooling mode according to a change in temperature of a storage chamber according to an embodiment of the present invention.

In general, the heating target temperature T11, which is the storage chamber target temperature in the heating mode, and the cooling target temperature T12, which is the storage chamber target temperature in the cooling mode, are set to the same temperature. However, the heating target temperature T11, which is the storage chamber target temperature in the heating mode, and the cooling target temperature T12, which is the storage chamber target temperature in the cooling mode, may be set to different temperatures.

Preferably, the heating target temperature T11 may be set lower than the cooling target temperature T12. For example, the heating target temperature T11 may be set lower than the cooling target temperature T12 by 0.2° C. to 1° C.

If the heating target temperature T11 is set lower than the cooling target temperature T12, the storage chamber temperature satisfaction condition in a temperature rise section after the standby mode is switched to the heating mode after the cooling mode is ended will be lower than the storage chamber temperature satisfaction condition in the previous cooling mode. Due to this, the storage chamber is overheated, and the temperature to be switched to the cooling mode is also lowered, so that the switching to the cooling mode can be accelerated.

For example, if the heating target temperature T11 and the cooling target temperature T12 are set equally to 10° C., the upper limit value of the storage chamber target temperature in the heating mode is set to 10° C.+3° C., the upper limit temperature thereof is set to 10° C.+5° C., and the heating mode is shifted to a cooling mode after going through a standby mode, based on the 13° C. or 15° C.

On the other hand, if the heating target temperature T11 is 7° C. and the cooling target temperature T12 is 10° C., the upper limit value of the storage chamber target temperature in the heating mode is set to 7° C.+3° C., and the upper limit temperature thereof is set to 7° C.+5° C., and the heating mode is switched to the cooling mode after going through the standby mode based on the 10° C. or 12° C. In other words, it is possible to prevent the deterioration of the quality of storage goods stored in the storage chamber due to the overheating of the storage chamber, and the time to switch to the cooling mode may be faster.

On the other hand, if the heating target temperature T11 is set lower than the cooling target temperature T12, that is, if the cooling target temperature T12 is set higher than the heating target temperature T11, after the heating mode is ended, in the standby mode, the storage chamber satisfaction condition in a temperature dropping section becomes higher than the storage chamber satisfaction condition in the previous heating mode. Due to this, the storage chamber is supercooled, and the temperature section to be switched to the heating mode is also high, so that the switching to the heating mode can be accelerated. The opposite case of the example described above is conceivable. Due to this, it is possible to prevent the deterioration of the quality of storage goods stored in the storage chamber due to the supercooling of the storage chamber, and the time to switch to the heating mode may be faster.

The above description is merely illustrative of the technical idea of the present disclosure, and a person skilled in the art to which the present disclosure pertains may make various modifications and changes without departing from the essential characteristics of the present disclosure.

Therefore, the embodiments disclosed in the present disclosure are not intended to limit the technical idea of the present disclosure but to describe the present disclosure, and the scope of the technical idea of the present disclosure is not limited by these embodiments.

The protection scope of the present disclosure should be interpreted by the following claims, and all technical ideas within the scope equivalent thereto should be construed as being included in the scope of the present disclosure.

The invention claimed is:

1. A refrigerator comprising:

a cabinet in which a storage chamber is formed;

a cooler to cool the storage chamber;

a heater to heat the storage chamber;

a temperature sensor to sense a storage chamber temperature; and a controller configured to control the cooler and the heater, wherein the controller is configured to selectively perform a plurality of modes, wherein the plurality of modes include:

a cooling mode in which the cooler is operated or stopped, a heating mode in which the heater is operated or stopped, and a standby mode in which the cooler and the heater are stopped, and wherein the plurality of modes are performed in the order of the cooling mode, the standby mode, and heating mode, or are performed in the order of the heating mode, the standby mode, and the cooling mode.

2. The refrigerator of claim 1, wherein, in the cooling mode, the cooler is operated when the storage chamber temperature sensed by the temperature sensor exceeds a target temperature upper limit value and is stopped when the storage chamber temperature is lower than a target temperature lower limit value, and wherein, in the heating mode, the heater is stopped when the storage chamber temperature exceeds the target temperature upper limit value and is operated when the storage chamber temperature is lower than the target temperature lower limit value.

3. The refrigerator of claim 2, wherein, in the standby mode, the storage chamber temperature is between the target temperature lower limit value and a lower limit temperature, or between the target temperature upper limit value and an upper limit temperature, wherein the lower limit temperature is a temperature lower than the target temperature lower limit value, and wherein the upper limit temperature is a temperature higher than the target temperature upper limit value.

4. The refrigerator of claim 3, wherein, after the cooling mode is ended, when a time in which the storage chamber temperature is between the target temperature lower limit value and the lower limit temperature is equal to or greater than a first set time, the controller is configured to switch from the standby mode to the heating mode.

5. The refrigerator of claim 4, wherein, after the cooling mode is ended, when a time in which the storage chamber temperature is lower than the lower limit temperature is equal to or greater than a second set time, the controller is configured to switch from the standby mode to the heating mode.

6. The refrigerator of claim 5, wherein the second set time is shorter than the first set time.

7. The refrigerator of claim 3, wherein, after the heating mode is ended, when a time in which the storage chamber temperature is between the target temperature upper limit value and the upper limit temperature is equal to or greater than a first set time, the controller is configured to switch from the standby mode to the cooling mode.

8. The refrigerator of claim 7, wherein, after the heating mode is ended, when a time in which the storage chamber temperature exceeds the upper limit temperature is equal to or greater than a second set time, the controller is configured to switch from the standby mode to the cooling mode.

9. The refrigerator of claim 8, wherein the second set time is shorter than the first set time.

10. The refrigerator of claim 1, further comprising:

a timer; and an input unit to receive an input of a target temperature, wherein the controller is configured to selectively perform the plurality of modes according to the input received by the input unit, a value of the timer, and the storage chamber temperature sensed by the temperature sensor.

11. The refrigerator of claim 1, further comprising:

an airflow forming mechanism to flow air in the storage chamber, wherein the controller is configured to operate the airflow forming mechanism in the cooling mode.

12. The refrigerator of claim 1, further comprising:

an airflow forming mechanism to flow air in the storage chamber, wherein the controller is configured to stop the airflow forming mechanism from operating in the standby mode.

13. The refrigerator of claim 1, further comprising:

an airflow forming mechanism to flow air in the storage chamber, wherein the controller is configured to the airflow forming mechanism in the heating mode.

14. The refrigerator of claim 1, wherein the cabinet includes an inner case in which the storage chamber is formed, further comprising:

an inner guide to partition the storage chamber into a storage space and an air flow path disposed inside the inner case, and an airflow forming mechanism including a circulation fan which is disposed in the inner case or the inner guide to circulate air in the storage space.

15. The refrigerator of claim 1, wherein the cabinet includes an inner case in which the storage chamber is formed, an inner guide to partition the storage chamber into a storage space and an air flow path disposed in the inner case, a partition member which partitions the storage space into a first space and a second space disposed in the storage space, and wherein the heater is a plurality of heaters provided for each of the first space and the second space.

16. The refrigerator of claim 1, wherein the cabinet includes an inner case in which the storage chamber is formed, further comprising an inner guide which faces a rear body of the inner case, and the heater includes a side heating device installed on a side body of the inner case.

17. The refrigerator of claim 16, further comprising a partition member which partitions the storage space into a first space and a second space disposed in the storage space, wherein the heater includes an inner heating device disposed on the partition member.

18. The refrigerator of claim 14, further comprising a circulation flow path partitioned from the air flow path and in communication with the storage chamber, wherein the circulation flow path is formed so that air passing through the circulation flow path is not mixed with air passing through the air flow path while passing through the circulation flow path.

19. The refrigerator of claim 18, wherein the circulation flow path is formed in the inner guide.

20. The refrigerator of claim 18, wherein the airflow forming mechanism includes a first fan disposed in the air flow path to blow the air passing through the air flow path and a second fan disposed outside of the air flow path to blow the air passing through the circulation flow path.

* * * * *